US008330364B2

(12) United States Patent
Ohmura et al.

(10) Patent No.: US 8,330,364 B2
(45) Date of Patent: Dec. 11, 2012

(54) PHOTOMULTIPLIER

(75) Inventors: Takayuki Ohmura, Hamamatsu (JP); Hiroyuki Kyushima, Hamamatsu (JP); Hideki Shimoi, Hamamatsu (JP); Tsuyoshi Kodama, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 379 days.

(21) Appl. No.: 12/388,961

(22) Filed: Feb. 19, 2009

(65) Prior Publication Data

US 2009/0212699 A1 Aug. 27, 2009

Related U.S. Application Data

(60) Provisional application No. 61/030,364, filed on Feb. 21, 2008.

(51) Int. Cl.
*H01J 43/18* (2006.01)

(52) U.S. Cl. ..... 313/533

(58) Field of Classification Search ..... 313/308, 313/399, 523–544, 103 R, 103 CM, 104, 313/105 R, 105 CM
See application file for complete search history.

(56) References Cited

U.S. PATENT DOCUMENTS

| | | | | |
|---|---|---|---|---|
| 2,231,698 | A | 2/1941 | Zworykin et al. | |
| 3,684,910 | A | 8/1972 | Stutzman et al. | |
| 5,077,504 | A * | 12/1991 | Helvy | 313/103 R |
| 5,841,231 | A | 11/1998 | Kimura et al. | |
| 7,323,674 | B2 | 1/2008 | Kato et al. | |
| 2002/0079838 | A1 | 6/2002 | Bach et al. | |
| 2006/0220554 | A1 * | 10/2006 | Ohmura et al. | 313/532 |

FOREIGN PATENT DOCUMENTS

| | | |
|---|---|---|
| CN | 1304542 | 7/2001 |
| EP | 1 914 790 | 4/2008 |
| JP | 3-254058 | 11/1991 |
| JP | 10-214588 | 8/1998 |
| JP | 10-214589 | 8/1998 |
| WO | WO 2005/091332 | 9/2005 |

* cited by examiner

*Primary Examiner* — Anh Mai
*Assistant Examiner* — Andrew Coughlin
(74) *Attorney, Agent, or Firm* — Drinker Biddle & Reath LLP

(57) ABSTRACT

The present invention relates to a photomultiplier that realizes a significant improvement of response time characteristics by a structure enabling mass production. The photomultiplier comprises a sealed container, and, in the sealed container, a photocathode, an electron multiplier section, and an anode are respectively disposed. The electron multiplier section includes multiple stages of dynode units, and each of the multiple stages of dynode units is fixed with one end of the associated dynode pin while being electrically connected thereto. In particular, the dynode pin, whose one ends are fixed to the multiple stages of dynode units, are held within an effective region of the electron multiplier section contributing to secondary electron multiplication, when the electron multiplier section is viewed from the photocathode side. By this configuration, a focusing distance from the photocathode to a first stage dynode unit can be shortened effectively and the effective region of the electron multiplier section can be enlarged to effectively reduce variations in transit time of photoelectrons propagating from the photocathode to the first stage dynode unit.

13 Claims, 24 Drawing Sheets

PHOTOMULTIPLIER

CROSS-REFERENCE TO RELATED APPLICATION

This application claims priority to Provisional Application No. 61/030,364 filed on Feb. 21, 2008 by the same Applicant, which is hereby incorporated by reference in its entirety.

BACKGROUND OF THE INVENTION

1. Field of the Invention

The present invention relates to a photomultiplier capable of successively emitting secondary electrons in multiple stages in response to incidence of photoelectrons from a photocathode and thereby performing cascade multiplication of the secondary electrons.

2. Related Background Art

The development of TOF-PET (time-of-flight PET) as a next-generation PET (positron emission tomography) apparatus is being pursued actively in the field of nuclear medicine in recent years. In a TOF-PET apparatus, because two gamma rays, emitted from a radioactive isotope administered into a body, are measured simultaneously, a large number of photomultipliers having excellent, high-speed response properties are used as measuring devices disposed so as to surround a subject.

In particular, in order to realize high-speed response properties of higher stability, multichannel electron multipliers, in which a plurality of electron multiplier channels are prepared and electron multiplications are performed in parallel at the plurality of electron multiplier channels, are being applied to next-generation PETs such as that mentioned above in an increasing number of cases. For example, a multichannel electron multiplier described in International Publication WO2005/091332 has a structure in which a single incidence surface plate is partitioned into a plurality of light incidence regions (each being a photocathode to which a single electron multiplier channel is allocated), and a plurality of electron multiplier sections (each including a dynode unit, in turn including multiple stages of dynodes, and an anode), prepared as electron multiplier channels that are allocated to the plurality of light incidence regions, are sealed inside a single glass tube. A photomultiplier with the structure where a plurality of photomultipliers are contained inside a single glass tube is generally called a multichannel photomultiplier.

A multichannel photomultiplier thus has a structure where a function of a single-channel photomultiplier, in which photoelectrons emitted from a photocathode disposed on an incidence surface plate are electron multiplied by a single electron multiplier section to obtain an anode output, is shared by the plurality of electron multiplier channels. For example, with a multichannel electron multiplier, with which four light incidence regions (photocathodes for electron multiplier channels) are arrayed in two dimensions, because for one electron multiplier channel, a photoelectron emission region (effective region of the photocathode) is made ¼ or less of the incidence surface plate, electron transit time differences among the respective electron multiplier channels can also be improved readily. Consequently, in comparison to the electron transit time differences within the entirety of a single channel photomultiplier, a significant improvement in electron transit time differences can be anticipated with the entirety of a multichannel electron multiplier.

SUMMARY OF THE INVENTION

The present inventors have examined the above conventional multichannel photomultiplier, and as a result, have discovered the following problems. That is, in the conventional multichannel photomultiplier, because electron multiplications are performed by electron multiplier channels that are allocated in advance according to positions of discharge of photoelectrons from the photocathode, positions of respective electrodes are designed optimally to reduce electron transit time differences according to each electron multiplier channel. By such improvement of the electron transit time differences in each electron multiplier channel, improvements are also made in the electron transit time differences of the multichannel photomultiplier as a whole and consequently, the high-speed response properties of the multichannel photomultiplier as a whole are improved.

However, in such a multichannel photomultiplier, no improvements have been made in regard to the spread of the average electron transit time differences among the electron multiplier channels. Also, in regard to a light exiting surface (surface positioned in the interior of the sealed container) of the incidence surface plate on which the photocathode is formed, the light exiting surface is distorted in shape in a peripheral region that surrounds a central region, which includes a tube axis of the sealed container, and especially in boundary portions (edges of the light exiting surface) at which the light exiting surface and an inner wall of a bulb intersect. Equipotential lines between the photocathode and the dynodes or between the photocathode and the focusing electrode are thereby distorted, and even within a single channel, photoelectrons that fall astray may be generated depending on the photoelectron emission position. The presence of such stray photoelectrons cannot be ignored for further improvement of high-speed response properties.

Furthermore, because a large number of photomultipliers are required for the manufacture of a TOF-PET apparatus, adoption of a structure that is more suited for mass production is desired with photomultipliers that are applied to a TOF-PET apparatus, etc.

The present invention has been developed to eliminate the problems described above. It is an object of the present invention to provide a photomultiplier that is significantly improved as a whole in such response time characteristics as TTS (transit time spread) and CTTD (cathode transit time difference) by realizing reduction of emission-position-dependent photoelectron transit time differences of photoelectrons emitted from a photocathode in a structure more suited for mass production.

Presently, PET apparatuses having a TOF (time-of-flight) function added are being developed. In photomultipliers used in such a TOF-PET apparatus, CRT (coincidence resolving time) response characteristics are also important. Conventional photomultipliers do not meet the CRT response characteristics requirements of TOF-PET apparatuses. Because the present invention is based on a conventional PET apparatus, a bulb outer diameter is maintained in its current state, and trajectory design is carried out to enable CRT measurements that meet the requirements of a TOF-PET apparatus. Specifically, improvement of the TTS, which is correlated with the CRT response characteristics, is aimed at, and trajectory design is carried out to improve both the TTS across an entire incidence surface plate and the TTS in respective incidence regions.

A photomultiplier according to the present invention comprises, together with a sealed container whose interior is depressurized to a predetermined degree of vacuum, a photocathode; an electron multiplier section including multiple stages of dynode units, and an anode that are respectively disposed inside the sealed container. The photomultiplier further comprises a plurality of lead pins (hereinafter referred to as "dynode pins") for setting each of the multiple stages of dynode units to a predetermined potential. The photocathode emits photoelectrons into the sealed container in response to light with a predetermined wavelength. The electron multiplier section includes N (≧2) stages of dynode units to emit secondary electrons in response to the photoelectrons arriving from the photocathode and perform successive cascade multiplication of the secondary electrons. The N stages of dynode units are stacked via insulating spacers from the photocathode toward the anode. Each of the dynode units has one or more dynodes that are respectively set to a same potential. The anode is disposed inside the sealed container so as to sandwich the electron multiplier section together with the photocathode and captures the secondary electrons emitted from the electron multiplier section. One end of each of the dynode pins is fixed while being electrically connected to the associated dynode unit.

In particular, the photomultiplier according to the present invention has a structure where the plurality of dynode pins are held within an effective region in the electron multiplier section defined as a minimum field region containing all dynodes constituting the multiple stages of dynode units when the electron multiplier section is viewed from the photocathode side. In the present specification, the effective region in the electron multiplier section is the field region, contributing to secondary electron multiplication, as viewed from the photocathode side and is defined as an electron incidence surface of the electron multiplier section on a plane orthogonal to a central axis of a bulb of the sealed container. More specifically, the field region is a minimum region that, when contours of all dynodes included in the electron multiplier section are projected onto the electron incidence surface of the electron multiplier section, contains all projected components of the contours. A boundary line defining the effective region of the electron multiplier section thus partially coincides with a portion of projected components of one of the dynode contours.

In a conventional photomultiplier, the dynode pins are disposed along a periphery of the effective region of the electron multiplier section that avoids the effective region in which the dynodes are disposed and are specifically disposed along an outer periphery of a frame that supports the dynodes. Meanwhile, with the photomultiplier according to the present invention, because the dynode pins are disposed inside the effective region of the electron multiplier section, the effective region of the electron multiplier section can be enlarged as compared with the conventional photomultiplier. By enlargement of the effective region, trajectory modifications, especially of photoelectrons emitted from a periphery of the photocathode opposing the electron incidence surface of the electron multiplier section, are lessened in degree, and a focusing distance (transit distance of photoelectrons to arrival at the dynode unit of the first stage from the photocathode) is thus reduced significantly.

In each dynode unit, the plurality of dynodes that are respectively set to the same potential are disposed so that the fixed one end of the associated dynode pin is sandwiched by at least two of the dynodes. In particular, an n-th (2≦n≦N) stage dynode unit from the photocathode toward the anode includes: the dynodes, respectively set to the same potential; a supporting frame for maintaining fixed the intervals between the dynodes; and the associated dynode pin among the plurality of dynode pins. A portion of the supporting frame has a shape positioned between at least two dynodes among the plurality of dynodes and includes a through hole for letting the dynode pin associated to an (n−1)-th stage dynode unit penetrate through without electrical contact.

A portion of the insulating spacer, positioned between the n-th stage dynode unit and an (n+1)-th stage dynode unit, has a through hole holding the dynode pin associated to the (n−1)-th stage dynode unit and constitutes a part of the n-th stage dynode unit by being fixed to the n-th stage dynode unit. Here, the insulating spacer is disposed so that a center of the through hole coincides with a center of the through hole provided in the portion of the supporting frame in the n-th stage dynode unit. Furthermore, the insulating spacer, positioned between the n-th stage dynode unit and the (n+1)-th stage dynode unit has a structure for defining a position, along a direction directed from the photocathode to the anode, of the dynode pin associated to the n-th stage dynode unit.

More specifically, the supporting frame of the n-th stage dynode unit preferably has an H shape formed by a pair of supports, disposed so as to sandwich all of the plurality of dynodes, and a connecting portion, having both ends fixed to the pair of supports and disposed so as to be sandwiched by at least two dynodes among the dynodes set to the same potential. Here, the connecting portion is provided with a structure to which one end of the associated dynode pin is fixed. Likewise, the insulating spacer, positioned between the n-th stage dynode unit and the (n+1)-th stage dynode unit (and constituting a part of the n-th stage dynode unit), has an H shape to secure a space for supporting the dynodes and a space for a dynode pin supporting structure. That is, the insulating spacer also has a pair of supports, associated to the pair of supports of the supporting frame in the n-th stage dynode unit, and a connecting portion, associated to the connecting portion of the supporting frame in the n-th stage dynode unit. By making the insulating spacer have the H shape, a space can be provided between dynode units even when the dynode units are respectively stacked in closely contacting states, thereby enabling evacuation to be performed readily in a manufacturing process and enabling an alkali metal vapor to be supplied adequately from the photocathode to the respective dynode units. The alkali metal vapor means as a material gas for forming the photocathode and a secondary electron emitting surface of each dynode.

The through hole for letting the dynode pin associated to the (n−1)-th dynode unit penetrate through without electrical contact is thus formed in the connecting portion of the supporting frame in the n-th stage dynode unit. Likewise, the through hole for holding the dynode pin associated to the (n−1)-th stage dynode unit is formed in the connecting portion of the insulating spacer that constitutes a part of the n-th stage dynode unit, and this insulating spacer is disposed so that the center of the through hole coincides with the center of the through hole formed in the connecting portion of the supporting frame in the n-th stage dynode unit.

As an example of a structure for fixing the insulating spacer to the supporting frame and a dynode pin positioning structure, for example, a step is formed inside the through hole formed in the insulating spacer positioned between the n-th stage dynode unit and the (n+1)-th stage dynode unit. Meanwhile, a flange that contacts the step formed inside the through hole of the insulating spacer is disposed on the dynode pin associated to the n-th stage dynode unit. The position, along the direction directed from the photocathode to the anode, of the dynode pin associated to the n-th stage dynode is thus defined by the step. Also, when one end of a dynode pin is fixed to the supporting frame (connecting portion) of the associated dynode unit in a state where the flange contacts the step of the insulating spacer, the insulating spacer itself is pressed against the supporting frame by the flange. By such cooperation of the step formed in the through hole of the insulating spacer and the dynode pin, the structure for fixing the insulating spacer to the supporting frame and the dynode pin positioning structure are realized.

Furthermore, the insulating spacer positioned between the stacked dynode units may include a plurality of spacer elements. Specifically, the insulating spacer, positioned between the n-th stage dynode unit and the (n+1)-th stage dynode unit, includes a plurality of spacer elements, respectively having the same shape and being stacked in direct contacting states along the direction directed from the photocathode to the anode. In this case, by adjusting the number of the spacer elements, each dynode unit interval (interval between supporting frames) can be changed arbitrarily.

Also, the insulating spacer, positioned between the n-th stage dynode unit and (n+1)-th stage dynode unit, may have a plurality of light shielding portions arranged so as to plaster the openings sandwiched by the dynodes in the n-th stage dynode unit. Here, each of the light shielding portions has a plurality slits each letting an alkali metal vapor pass therethrough. The light shielding portions, provided in the insulating spacers positioned between the stacked dynode units, functions to prevent that light generated in the anode side reaches the photocathode side, and the slits make an alkali metal vapor for photocathode formation pass from the anode side to the photocathode side.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will be apparent to those skilled in the art from this detailed description.

BRIEF DESCRIPTION OF THE DRAWINGS

FIGS. 14A and 14B are stacked integrally;

DESCRIPTION OF THE PREFERRED EMBODIMENTS

In the following, embodiments of a photomultiplier according to the present invention will now be explained in detail with reference to FIGS. 1, 2A and 2B, 3 to 6, 7A to 12B, 13, 14A to 16B, 17, and 18A to 24B, respectively. In the description of the drawings, portions and elements that are the same shall be provided with the same symbol, and overlapping description shall be omitted.

Figure 1:
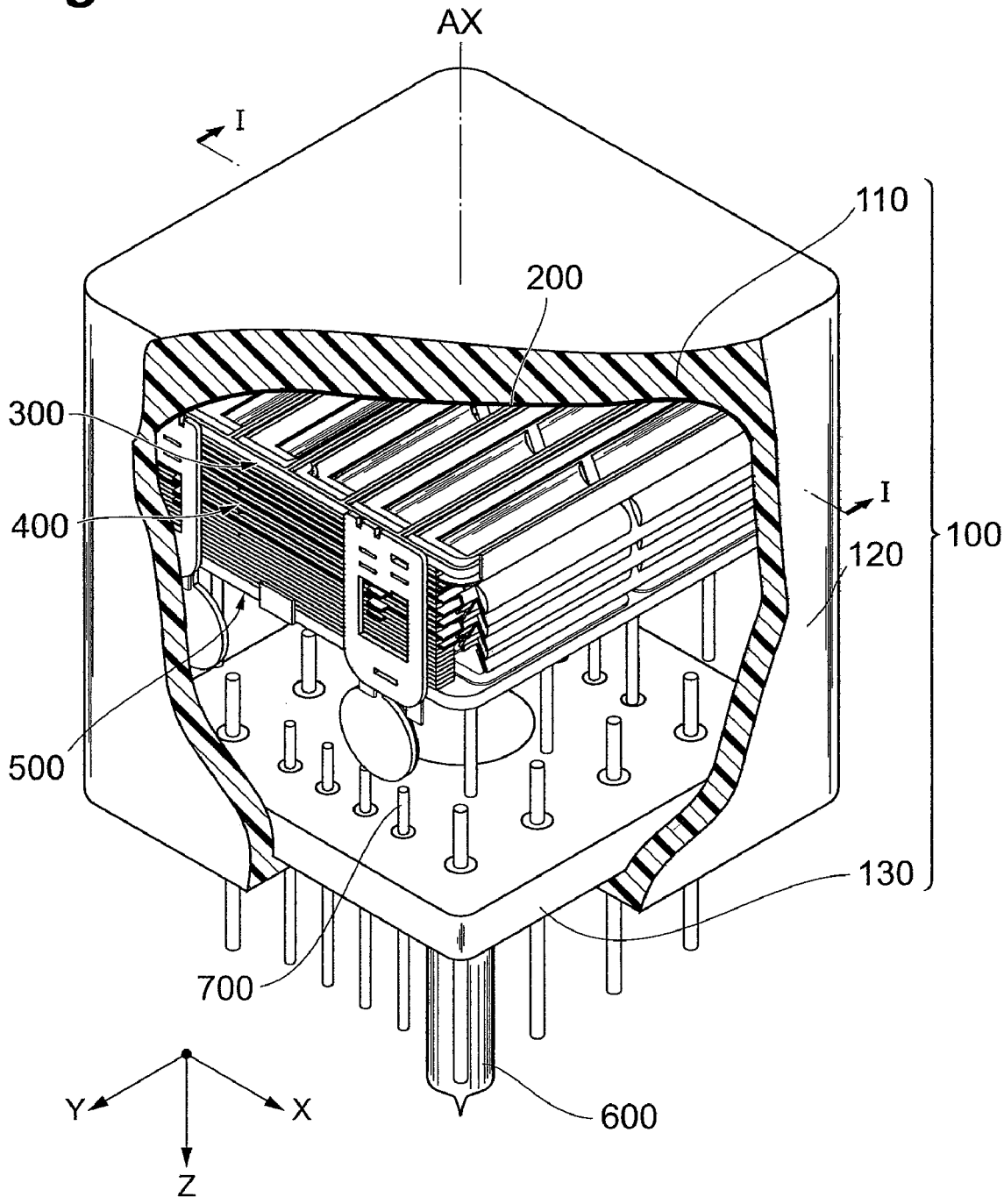
FIG. 1 is a partially broken-away view of a general configuration of an embodiment of a photomultiplier according to the present invention.
Figure 2A:
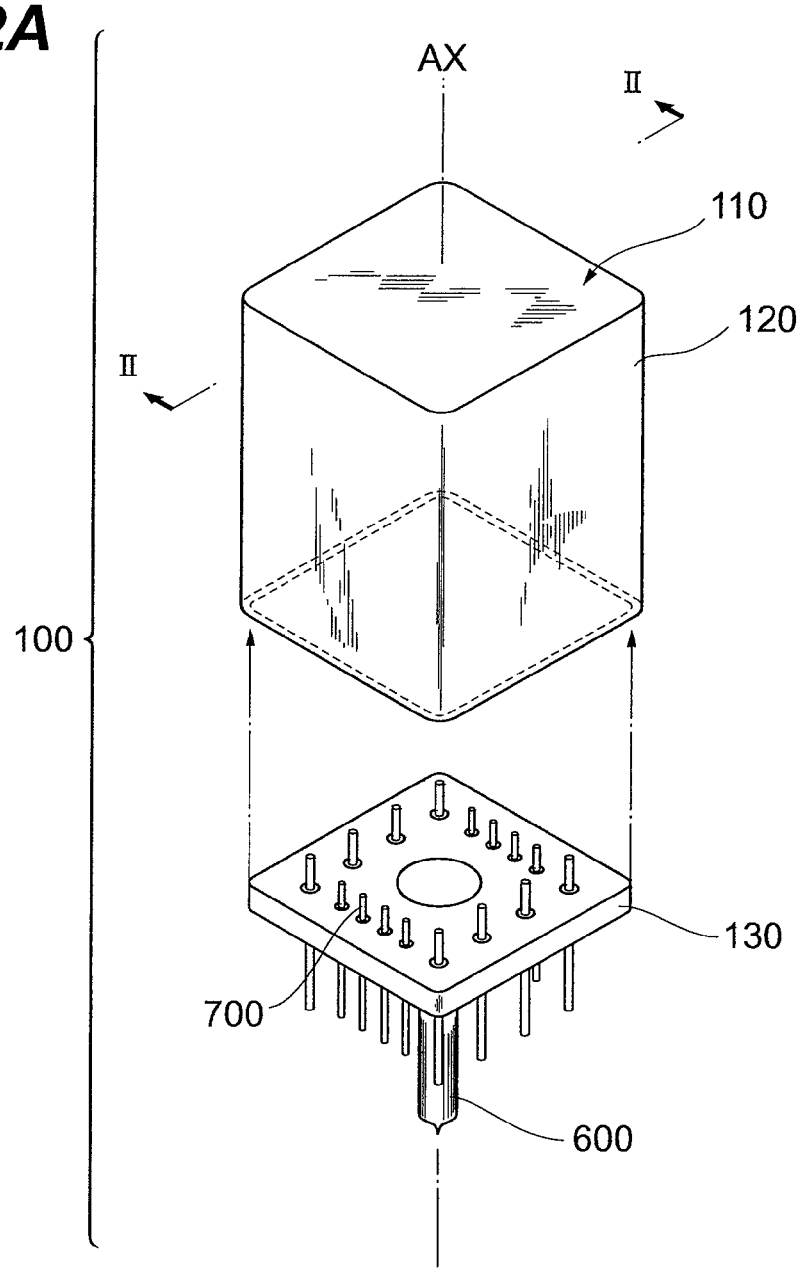
FIGS. 2A and 2B are an assembly process diagram and a sectional view for describing a structure of a sealed container in the photomultiplier according to the present invention.
Figure 2B:
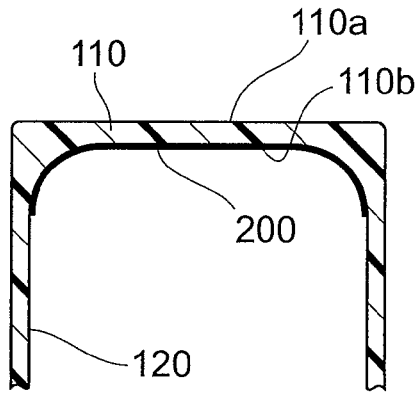
Figure 3:
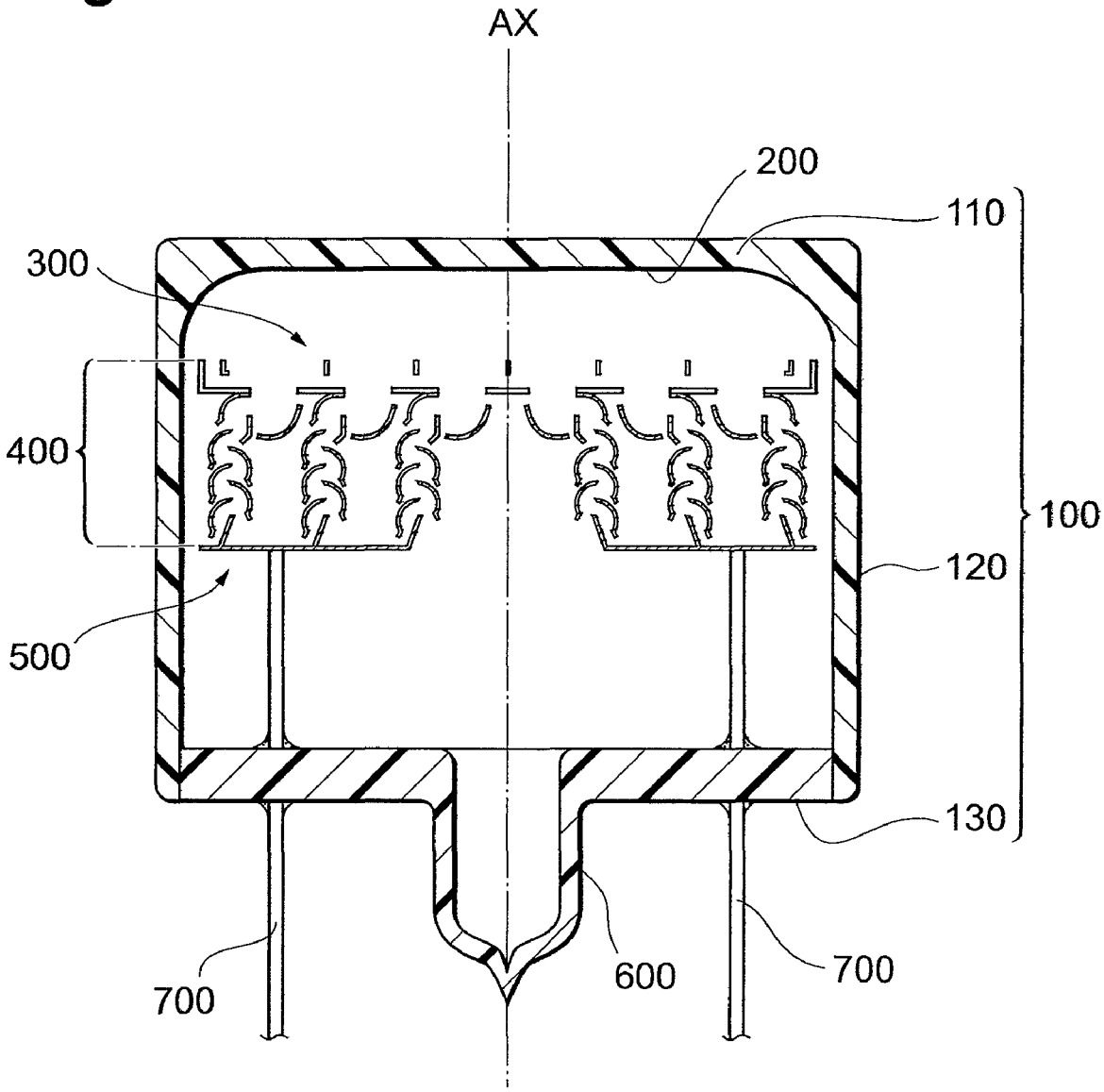
FIG. 3 is a diagram of a sectional structure taken on line I-I of the photomultiplier shown in FIG. 1.

FIG. 1 is a partially broken-away view of a general configuration of an embodiment of a photomultiplier according to the present invention. FIGS. 2A and 2B are an assembly process diagram and a sectional view for describing a structure of a sealed container in the photomultiplier according to the present invention. FIG. 3 is a diagram of a sectional structure taken on line I-I of the photomultiplier shown in FIG. 1.

As shown in FIG. 1, the photomultiplier according to the present invention comprises a sealed container 100, having a pipe 600, used to depressurize an interior of the sealed container 100 to a predetermined degree of vacuum (and the interior of which is filled after vacuum drawing), disposed at a bottom, and has a photocathode 200, a focusing electrode unit 300, an electron multiplier section 400, and an anode unit 500 disposed inside the sealed container 100.

As shown in FIG. 2A, the sealed container 100 is constituted by an envelope portion, and a stem 130 provided with the pipe 600, the stem 130 being joined by fusion to one end of the envelope portion and constitutes a bottom of the sealed container 100. A top 110 of the envelope portion functions as an incidence surface plate (hereinafter, the top of the envelope portion shall be referred to as the "incidence surface plate"). The envelope portion is a hollow glass member with which the incidence surface plate 110 and a bulb 120, extending along a predetermined tube axis AX, are formed integrally. FIG. 2B is a sectional view of the sealed container 100 taken on line I-I in FIG. 2A, and particularly shows a section of a vicinity of the incidence surface plate 110 including a portion of the bulb 120. The incidence surface plate 110 includes a light incidence surface 110*a* and a light exiting surface 110*b* opposing the light incidence surface 110*a*, and has the photocathode 200 formed on the light exiting surface 110*b* positioned at an inner side of the sealed container 100. The bulb 120 is a hollow glass member centered about the tube axis AX and extends along the tube axis AX. The incidence surface plate 110 is positioned at one end of the hollow member and the stem 130 is joined by fusion to the other end. The stem 130 has a through hole extending along the tube axis AX and putting the interior of the sealed container 100 in communication with an exterior. Lead pins 700 for electrical communication of the interior and the exterior of the sealed container 100 are disposed so as to surround the through hole. The lead pins 700 are connected to a bleeder circuit positioned at the exterior of the sealed container 100 and an amplifying circuit that amplifies an anode signal. At the position at which the through hole is disposed, the pipe 600, for evacuating the air inside the sealed container 100, is attached to the stem 130. The pipe 600 is sealed at one end at an end of manufacture of the photomultiplier to keep the interior of the sealed container 100 in an airtight, vacuum state.

An installation position of the electron multiplier section 400 in the tube axis AX direction inside the sealed container 100 is defined by the lead pins 700 that extend into the sealed container 100 from the stem 130. The focusing electrode unit 300, mainly including a focusing electrode and being for modifying trajectories of photoelectrons emitted into the sealed container 100 from the photocathode 200, is disposed on an electron incidence surface of the electron multiplier section 400.

To emit secondary electrons in response to photoelectrons arriving from the photocathode 200 via the focusing electrode unit 300 and perform successive cascade multiplication of the secondary electrons, the electron multiplier section 400 includes N (≧2) stages of dynode units as shown in FIG. 3. In the present embodiment, eight stages of dynode units are stacked via insulating spacers from the photocathode 200 toward the anode unit 500. In the present embodiment, the dynode unit stacked at a first stage includes a plurality of second dynodes, and the dynode unit stacked at a second stage includes a plurality of first dynodes. The first dynodes emit secondary electrons in response to the incidence of the photoelectrons from the photocathode 200, and the second dynode emits further secondary electrons in response to the incidence of the secondary electrons from the first dynodes. The first dynodes are held by the second stage dynode unit so that secondary electron incidence surfaces of the first dynodes directly oppose the photocathode 200 and the photoelectrons from the photocathode 200 are captured more efficiently. In the present embodiment, each dynode has a line focus type (inline type) cross-sectional shape.

In the description that follows, a multichannel photomultiplier, in which twelve electron multiplier channels CH1 to CH12 are formed by six series of electrode sets (dynode sets each forming two electron multiplier channels) disposed to sandwich the tube axis AX, shall be described as the embodiment of the photomultiplier according to the present invention.

Figure 4:
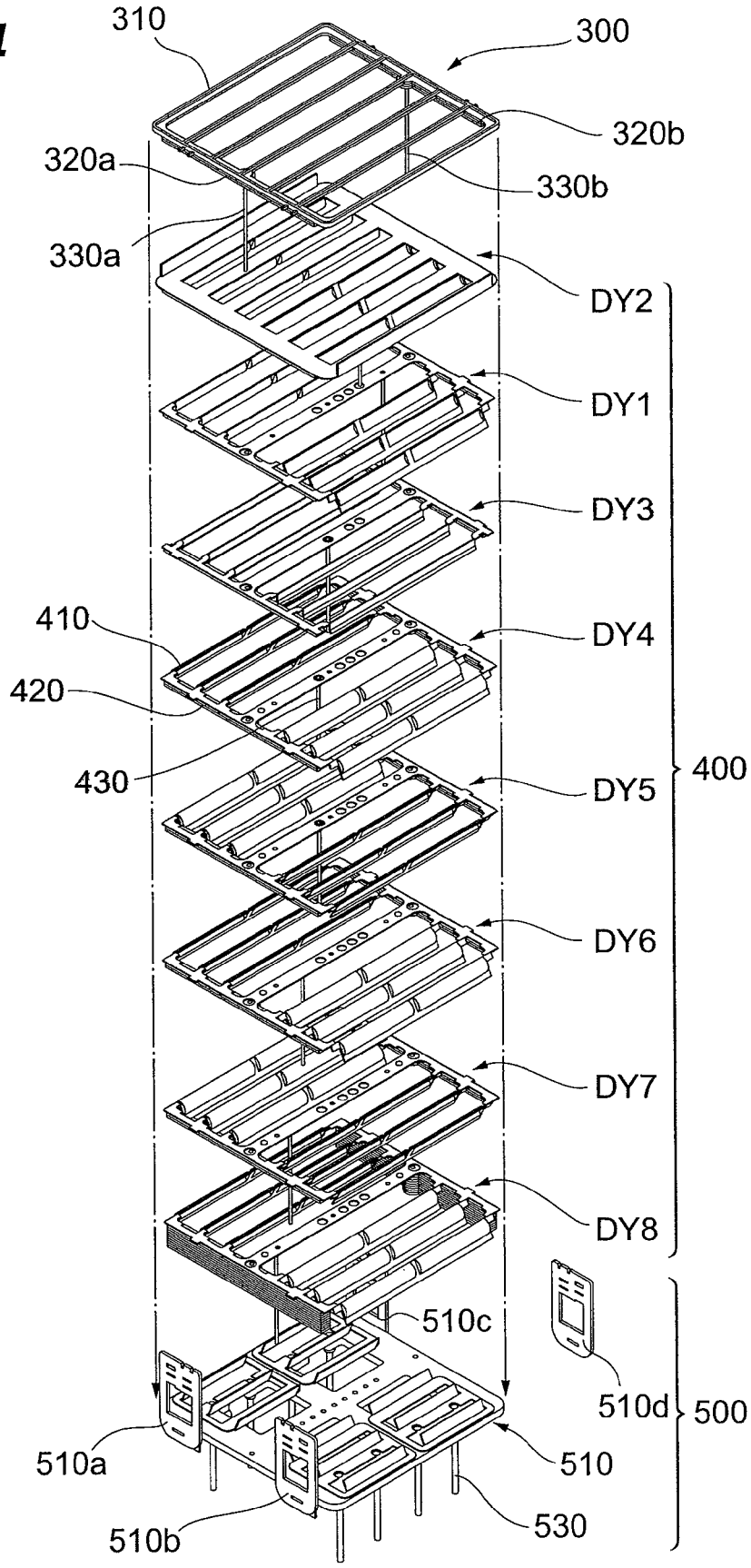
FIG. 4 is an assembly process diagram for describing respective structures of a focusing electrode unit, an electron multiplier section, and an anode unit in the photomultiplier according to the present invention.

First, FIG. 4 is an assembly process diagram for describing a structure of an internal unit (the focusing electrode unit 300, the electron multiplier section 400, and the anode unit 500) in the photomultiplier according to the present invention.

The focusing electrode unit 300 includes a metal frame (focusing electrode) 310, having a plurality of openings for letting photoelectrons pass through, insulating spacers 320*a* and 320*b*, and lead pins 330*a* and 330*b*. One ends of the lead pins 330*a* and 330*b* are fixed to the metal frame 310 via the insulating spacers 320*a* and 320*b*, and the other ends of the lead pins 330*a* and 330*b* penetrate through the electron multiplier section 400 and are electrically connected directly or via metal wires to the lead pins 700 fixed to the stem 130.

The electron multiplier section 400 includes eight stages of dynode units DY1 to DY8 stacked via insulating spacers. In the present specification, the first dynodes are the dynodes at which the photoelectrons from the photocathode 200 arrive first, and the other dynodes are hereinafter referred to as the second to eighth dynodes in an order of arrival of the secondary electrons. As mentioned above, in the present embodiment, the second dynodes are held by the first stage dynode unit, and the first dynodes are held by the second stage dynode unit. Thus in the description that follows, the first stage dynode unit holding the second dynodes shall be indicated as "DY2," the second stage dynode unit holding the first dynodes shall be indicated as "DY1," and subsequent dynode units shall be expressed respectively as "DY3" to "DY8" so that the dynodes that are held can be discerned. In the present embodiment, the dynode unit DY8 integrally holds final stage dynodes.

The dynode units DY1 to DY8 are respectively the same in basic structure, and for example, the fourth stage dynode unit DY4 (holding the fourth dynodes) includes: a supporting frame 410, supporting the plurality of fourth dynodes; an insulating spacer 420; and a dynode lead pin (dynode pin) 430 for setting the fourth stage dynode unit DY4 to a predetermined potential. Each of the respective supporting frames 410 of the dynode units DY1 to DY8 has formed therein through holes for allowing the dynode pins 430 of the dynode units positioned at upper stages to pass through without the electrical connection.

The anode unit 500 includes: a ceramic substrate 510; a plurality of electrodes (anode electrodes) 520, disposed on the ceramic substrate 510 and functioning as anodes; and a plurality of lead pins 530, one ends of which are connected to the anode electrodes 520. The one ends of the lead pins 530 are fixed to the anode electrodes 520 via the ceramic substrate 510 and the other ends of the lead pins 530 are electrically connected directly or via metal wires to the lead pins 700 fixed to the stem 130.

Figure 5:
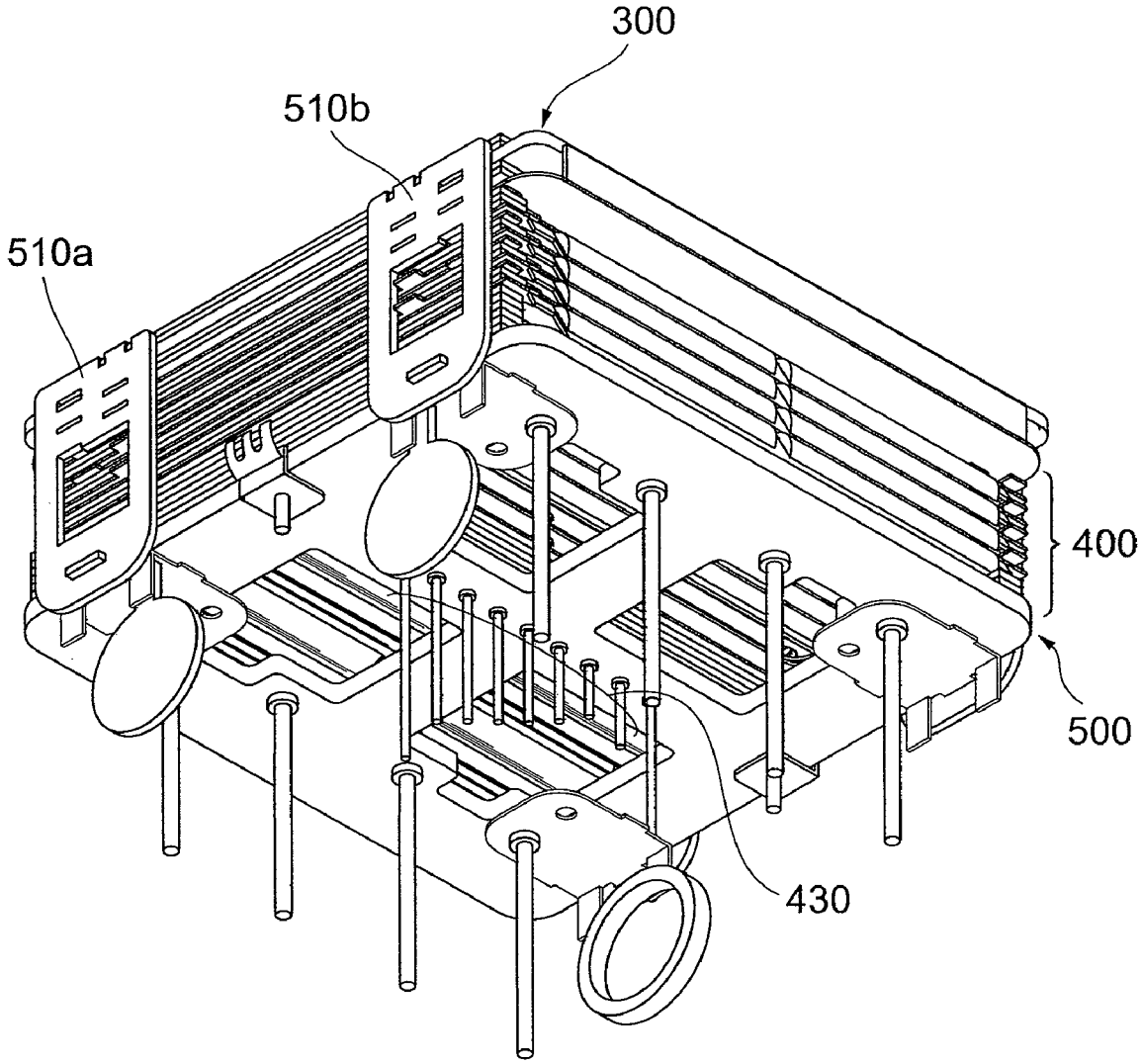
FIG. 5 is a schematic perspective view of an internal unit (unit in which the focusing electrode unit, the electron multiplier section, and the anode unit are stacked integrally) completed via the assembly process shown in FIG. 4.

The focusing electrode unit 300, the multiple stages of dynode units DY1 to DY8, and the anode unit 500 as described above are respectively stacked along a direction directed from the photocathode 200 to the anode unit 500. The stacked state is maintained by attachment of side wall substrate members 510*a* to 510*d* (see FIG. 6), which are insulation, for preventing deviation of the stacked dynodes and the respective units, to side surfaces of the stacked units. The internal unit (unit in which the focusing electrode unit, the electron multiplier section, and the anode unit are stacked integrally) completed via the above-described assembly process is schematically shown in FIG. 5. As shown in FIG. 5, the dynode pins 430 respectively associated to the dynode units DY1 to DY8 penetrate through the ceramic substrate 510 of the anode unit 500 in a state of being aligned in a straight line inside an effective region AR1 of the electron multiplier section 400 to be described below. The other ends of the dynode pins 430 are electrically connected directly or via metal wires to the lead pins 700 extending from the stem 130.

Respective set potentials of the first stage dynode unit DY2, the second stage dynode unit DY1, the third stage dynode unit DY3, . . . , the eighth stage dynode unit DY8 are increased in the order of the first dynodes to the eighth dynodes to guide the secondary electrons successively to the dynodes of subsequent stages. Thus, the potential of the anode electrodes 520 in the anode unit 500 is higher than the potential of the eighth dynodes. For example, the photocathode 200 is set to −1000V, the first dynodes held by the second stage dynode unit DY1 are set to −800V, the second dynode held by the first stage dynode unit DY2 are set to −700V, the third dynodes held by the third stage dynode unit DY3 are set to −600V, the fourth dynodes held by the fourth stage dynode unit DY4 are set to −500V, the fifth dynodes held by the fifth stage dynode unit DY5 are set to −400V, the sixth dynodes held by the sixth stage dynode unit DY6 are set to −300V, the seventh dynodes held by the seventh stage dynode unit DY7 are set to −200V, the eighth dynodes held by the eighth stage dynode unit DY8 are set to −100V, and the anode electrodes 520 are set to the ground potential (0V). The focusing electrode unit 300 is set to the same potential as the second dynodes held by the first stage dynode unit DY2.

The photoelectrons emitted from the photocathode 200 arrive at the first dynodes held by the second dynode unit DY1 after passing through the openings formed in the metal frame 310 of the focusing electrode unit 300 that is set to the same potential as the second dynodes. Secondary electron emitting surfaces are formed on electron arrival surfaces of the first dynodes, and in response to the incidence of photoelectrons, secondary electrons are emitted from the first dynodes. The secondary electrons emitted from the first dynodes propagate toward the second dynodes set to a higher potential than the first dynodes and held by the first stage dynode unit DY2. Secondary electron emission surfaces are also formed on electron arrival surfaces of the second dynodes, and the secondary electrons emitted from the secondary electron emitting surface of the second dynodes propagate toward the third dynodes, which are set to a higher potential than the second dynodes and held by the third stage dynode unit DY3. As the secondary electrons emitted from secondary electron emitting surfaces of the third dynodes propagate in a likewise manner in the order of the fourth dynodes, the fifth dynodes, the sixth dynodes, the seventh dynodes, and the eighth dynodes, respectively held by the fourth to eighth stage dynode units DY4 to DY8, the secondary electrons are cascade multiplied. The secondary electrons emitted from the eighth dynodes held by the final stage (eighth stage) dynode unit DY8 arrive at the anode electrodes 520 of the anode unit 500 and are taken out to the exterior of the sealed container 100 via the lead pins 700 electrically connected to the lead pins 530.

Figure 6:
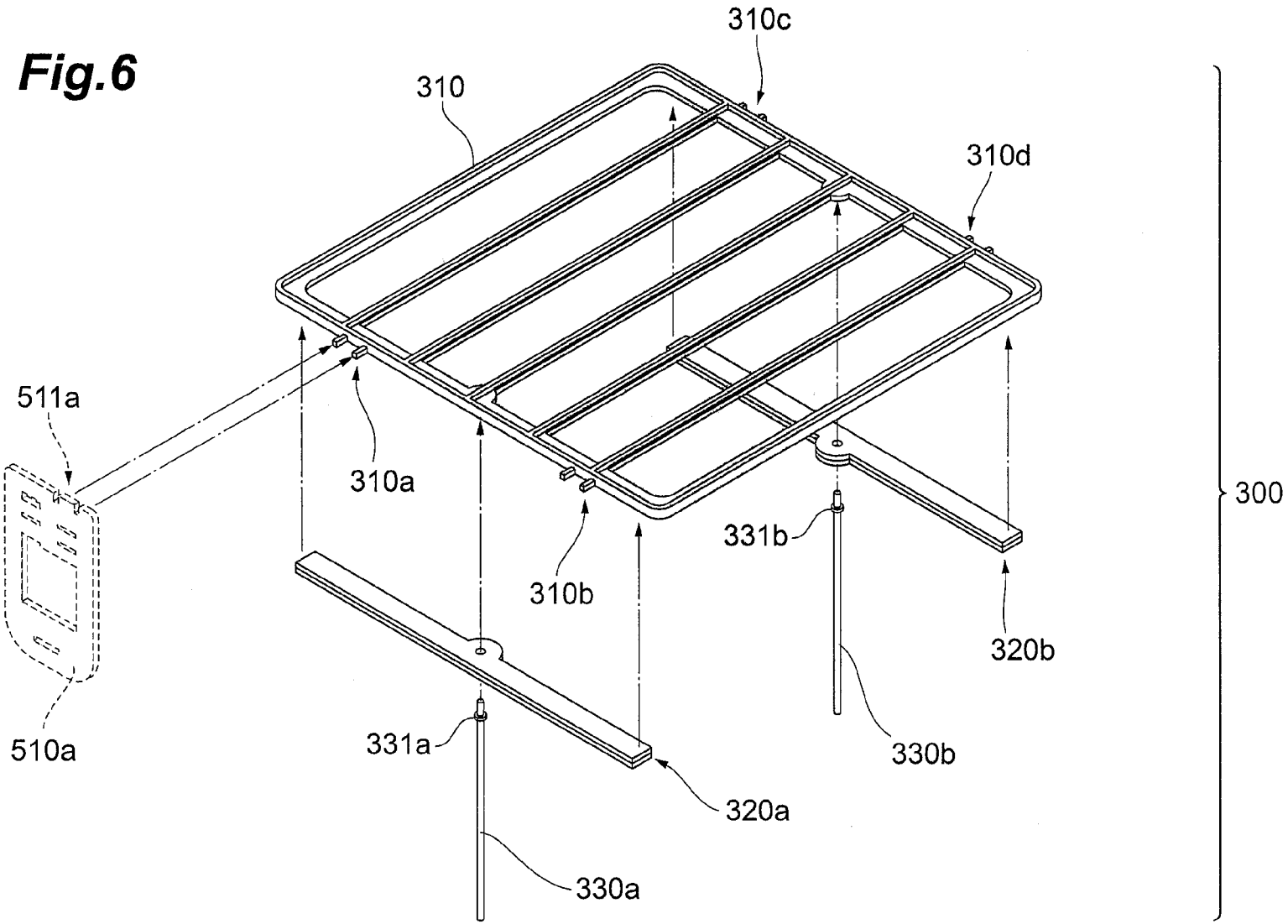
FIG. 6 is an assembly process diagram for describing a configuration of the focusing electrode unit.

A specific structure of the focusing electrode unit 300 shall now be described using FIG. 6. FIG. 6 is an assembly process diagram for describing a configuration of the focusing electrode unit 300.

As shown in FIG. 6, the focusing electrode unit 300 includes: the metal frame (focusing electrode) 310, having the plurality of openings for letting photoelectrons pass through; the insulating spacers 320*a* and 320*b*; and the lead pins 330*a* and 330*b*.

Specifically, the metal frame 310 includes an outer frame, having an opening area capable of containing the entire effective region of the electron multiplier section 400, and separating frames, each for partitioning an opening that exposes dynodes each functioning as two electron multiplier channels. The pair of insulating spacers 320*a* and 320*b* are fixed to a lower surface (surface opposing the anode unit 500) of the outer frame. The insulating spacers 320*a* and 320*b* function to electrically separate the electron multiplier section 400 and the focusing electrode unit 300 and maintain fixed an interval between the units 400 and 300. Through holes for letting the lead pins 330*a* and 330*b* of the metal frame 310 pass through are formed in the insulating spacers 320*a* and 320*b*. The one ends of the lead pins 330*a* and 330*b* are fixed by welding, crimping, etc., to an upper portion of the metal frame 310, and the other ends of the lead pins 330*a* and 330*b* are directly or indirectly connected to the lead pins 700 fixed to the stem 130. To assemble the focusing electrode unit 300, the lead pins (330*a*, 330*b*) are penetrated through the respective through holes with the metal frame 310 and the insulating spacers 320*a* and 320*b* being overlapped and then the ends of the lead pins 330*a* and 330*b* are fixed to the metal frame 310 by welding or crimping. Flanges 331*a* and 331*b* are disposed on the lead pins 330*a* and 330*b*, respectively, and because the flanges 331*a* and 331*b* cannot pass through the through holes formed in the insulating spacers 320*a* and 320*b* (that is, inner diameters of the through holes of the insulating spacers 320*a* and 320*b* are smaller than outer diameters of the flanges 331*a* and 331*b*), the respective members constituting the focusing electrode unit 300 are made integral by this assembly work. Furthermore, fixing tabs 310*a* to 310*d* for attaching the side wall substrate members 510*a* to 510*d* are disposed on an outer periphery of the outer frame. Only the side wall substrate member 510*a* among the side wall substrate members 510*a* to 510*d* is shown in FIG. 6 (illustration of the side wall substrate members 510*b* to 510*d* also is omitted). An engaging portion 511*a* is disposed at one end of the side wall substrate member 510*a*. By the fixing tabs 310*a* being joined to the engaging portion 511*a* after the focusing electrode unit 300, the electron multiplier section 400, and the anode unit 500 have been stacked as shown in FIG. 4, the side wall substrate member 510*a* functions to maintain the stacked structure. Although not illustrated, the remaining side wall substrate members 510*b* to 510*d* have the same structure and function in the same manner as the side wall substrate member 510*a*.

Meanwhile, the flanges that contact the insulating spacers 320*a* and 320*b* are disposed on the lead pins 330*a* and 330*b*, respectively. By the flanges thus being disposed on the lead pins 330*a* and 330*b*, respectively, the lead pins 330*a* and 330*b* are fixed to the metal frame 310 and the flanges function to press the insulating spacers 320*a* and 320*b* against the metal frame 310, and the insulating spacers 320*a* and 320*b* are thereby respectively fixed to the metal frame 310. The focusing electrode unit 300 may be assembled in the order of: fixing the lead pins 330*a* and 330*b* to the metal frame 310 and thereafter fixing the insulating spacers 320*a* and 320*b* to the metal frame 310 with the lead pins 330*a* and 330*b* being put in penetrating states.

Figure 7A:
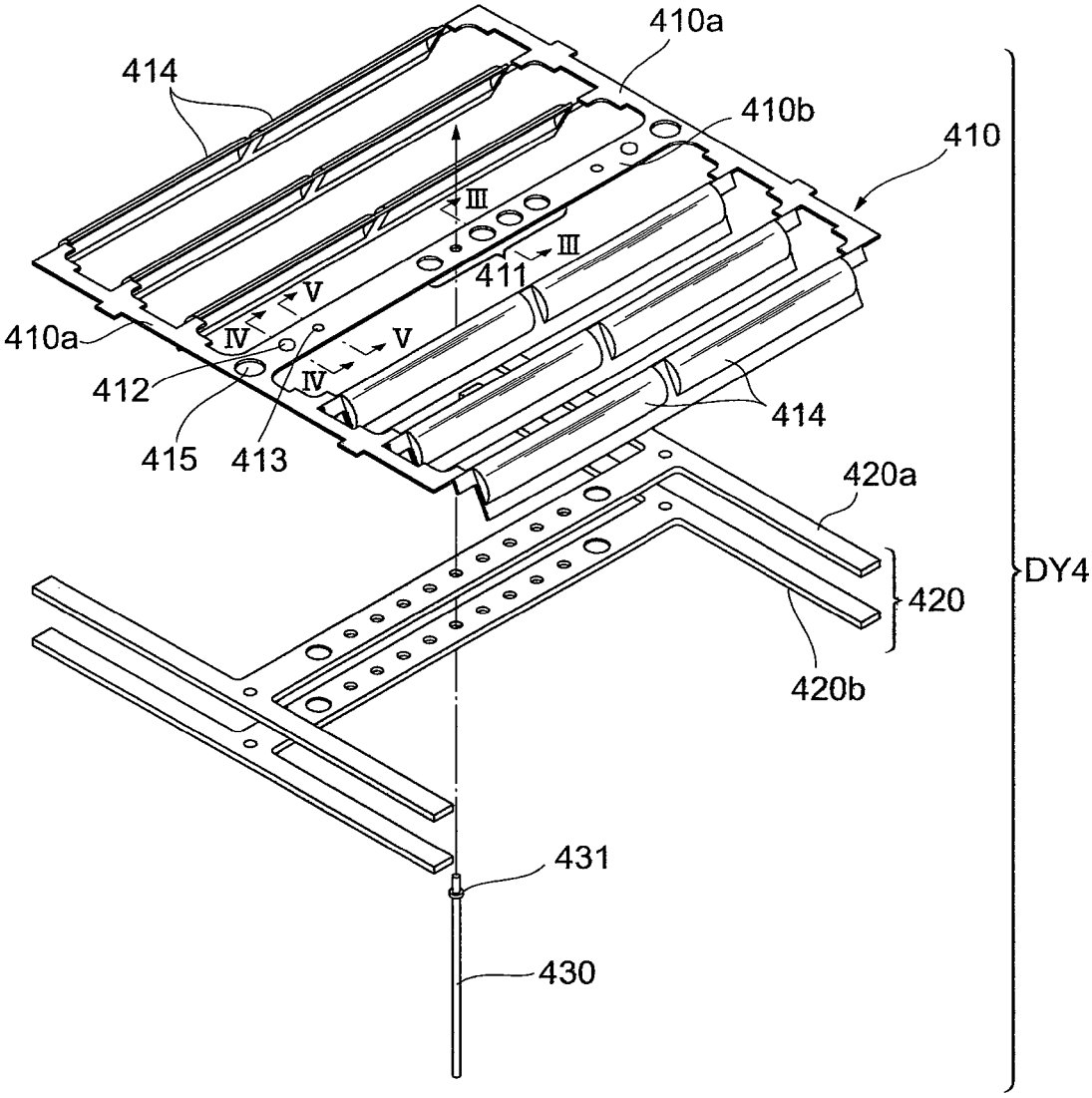
FIGS. 7A to 7D are an assembly process diagram and sectional views for describing a first configuration of a fourth stage dynode unit that constitutes a part of the electron multiplier section.
Figure 7B:
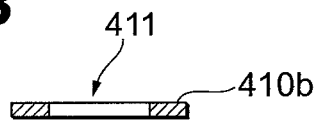
Figure 7D:
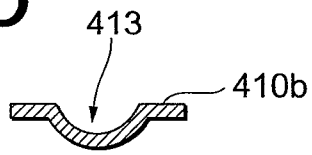
Figure 7C:
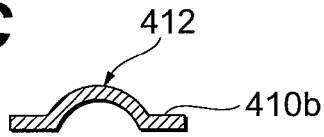

FIGS. 7A to 7D are an assembly process diagram and sectional views for describing a first configuration of the fourth stage dynode unit DY4 that constitutes a part of the electron multiplier section 400. The dynode units DY1 to DY8 that constitute the electron multiplier section 400 have the same basic structures as the fourth stage dynode unit DY4 shown in FIGS. 7A to 7D. FIGS. 7B to 7D are sectional views of a connecting portion 410*b* in the supporting frame 410, respectively.

The dynodes respectively held by the fourth, sixth, and eighth stage dynode units DY4, DY6, and DY8 are basically the same in a cross-sectional shape, and the dynodes respectively held by the fifth and seventh stage dynode units DY5 and DY7 are basically the same in a cross-sectional shape. The dynode units DY1 to DY8 of the respective stages include: the metal supporting frames 410; the ceramic insulating spacers 420 for electrically separating the dynode units DY1 to DY8 from each other and defining the intervals between the dynode units DY1 to DY8; and the metal dynode pins 430 prepared for the dynode units DY1 to DY8 respectively to set the dynode units DY1 to DY8 respectively to the predetermined potentials.

For example, as shown in FIG. 7A, in the case of the fourth stage dynode unit DY4, the supporting frame 410 is constituted by a pair of supports 410*a* disposed to sandwich all of the plurality of dynodes 414, and a connecting portion 410*b* with both ends fixed to the pair of supports 410*a* and being set to the same potential as the supports 410*a*. In particular, the connecting portion 410*b* is disposed so as to be sandwiched by at least two dynodes among the dynodes 414, and by the connecting portion 410*b* being disposed thus, the supporting frame 410 has an H shape.

The connecting portion 410*b* has formed therein through holes 411 for letting the dynode pins associated to the dynode units of at least the upper stages (the first to third stage dynode units DY1 to DY3 in the case of the fourth stage dynode unit DY4) penetrate through without electrical contact and a through hole for fixing one end of the associated dynode pin 430 by welding, crimping, etc., in a penetrated state. Here, the one end of the associated dynode pin 430 is electrically connected to the supporting frame 410, and the other end of the dynode pin 430 is directly or indirectly connected to the lead pin 700 fixed to the stem 130 while being in a state of penetrating through the dynode units positioned in lower stages. Also formed in the connecting portion 410*b* are through holes 415 for letting the lead pins 330*a* and 330*b*, the one ends of which are fixed while being electrically connected to the focusing electrode unit 300 positioned above the electron multiplier section 400, penetrate through to the stem 130 side. The connecting portion 410*b* furthermore has formed therein embosses 412 for positioning with respect to the insulating spacer of the upper stage dynode unit (the third stage dynode unit DY3 in the case of the fourth stage dynode unit DY4), and embosses 413 for positioning with respect to the insulating spacer 420 that is directly fixed to the supporting frame 410 itself. In particular, FIG. 7B shows a sectional structure of the through hole 411 in the connecting portion 410*b* taken on line III-III in FIG. 7A, FIG. 7C shows a sectional structure of the emboss 412 in the connecting portion 410*b* taken on line IV-IV in FIG. 7A, and FIG. 7D shows a sectional structure of the emboss 413 in the connecting portion 410*b* taken on line V-V in FIG. 7A.

The insulating spacer 420 also has an H shape like the supporting frame 410 and has portions associated to the pair of supports 410*a* and the connecting portion 410*b* that constitute the supporting frame 410. That is, the insulating spacer 420 also has a pair of supports and a connecting portion. In particular, through holes 423 are also formed in the connecting portion of the insulating spacer 420 at positions corresponding to the through holes 411 and 415 formed in the connecting portion 410*b* of the supporting frame 410. The through holes 423 are disposed to coincide with the centers of the through holes 411 and 415 formed in the connecting portion 410*b* of the supporting frame 410.

Furthermore, the insulating spacer 420 not only separates the dynode units of the respective stages from each other electrically but also defines the interval between dynode units. Thus in the present embodiment, the insulating spacer 420 includes a plurality of spacer elements 420*a* and 420*b* that have the same shape. By adjusting the number of the spacer elements, the dynode unit interval (interval between supporting frames) can be changed arbitrarily. The spacer elements 420*a* and 420*b* that constitute the insulating spacer 420 are stacked in direct contacting states along the direction directed from the photocathode 200 to the anode unit 500. For example, in the present embodiment, a single spacer element is installed respectively between the first stage dynode unit DY2 and the second stage dynode unit DY1, between the second stage dynode unit DY1 and the third stage dynode unit DY3, and between the third stage dynode unit DY3 and the fourth stage dynode unit DY4. Two spacer elements are installed in the respective intervals between the fourth to eighth stage dynode units DY4 to DY8. Eight spacer elements are installed between the eighth stage dynode unit DY8 and the anode unit 500.

To assemble each of the dynode units DY1 to DY8, the supporting frame 410 and the insulating spacer 420 is overlapped, and the dynode pin 430 is fixed to the supporting frame 410 with the dynode pin 430 penetrating through the respective through holes 411 and 423. That is, at an upper surface side of the supporting frame 410, the dynode pin 430 is fixed to the supporting frame 410 by welding the dynode pin 430 and the supporting frame 410 or by crimping an end of the dynode pin 430. Here, although below the focusing electrode unit 300, the respective dynode units are stacked in the order of: the dynode unit DY2, holding the second dynodes; and the dynode unit DY1, holding the first dynodes; the electron multiplication is performed in the order of: the first dynodes held by the second stage dynode unit DY1; and the second dynodes held by the first stage dynode unit DY2. Such a structure is adopted to stack the dynode units compactly and efficiently and yet realize optimal electron trajectories.

Figure 8A:
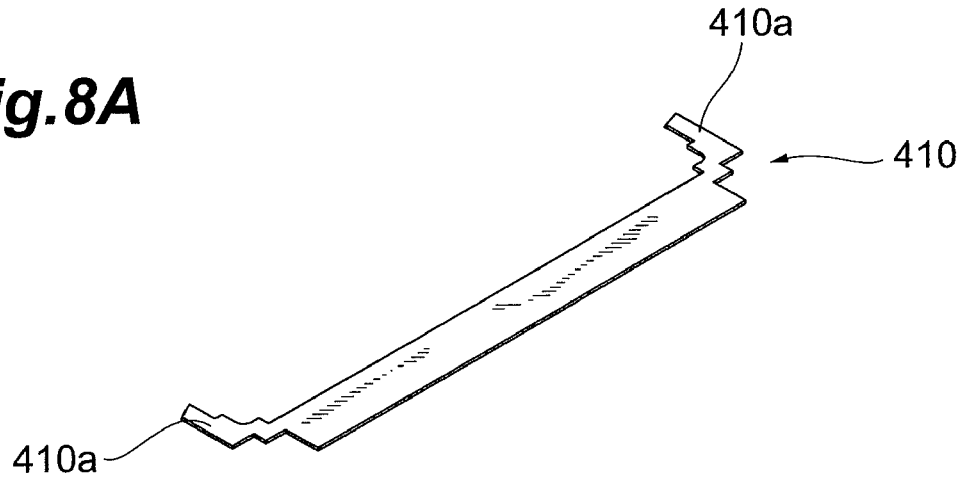
FIGS. 8A to 8C are process diagrams for describing a method for manufacturing dynodes in each dynode unit (FIG. 7A)
Figure 8B:
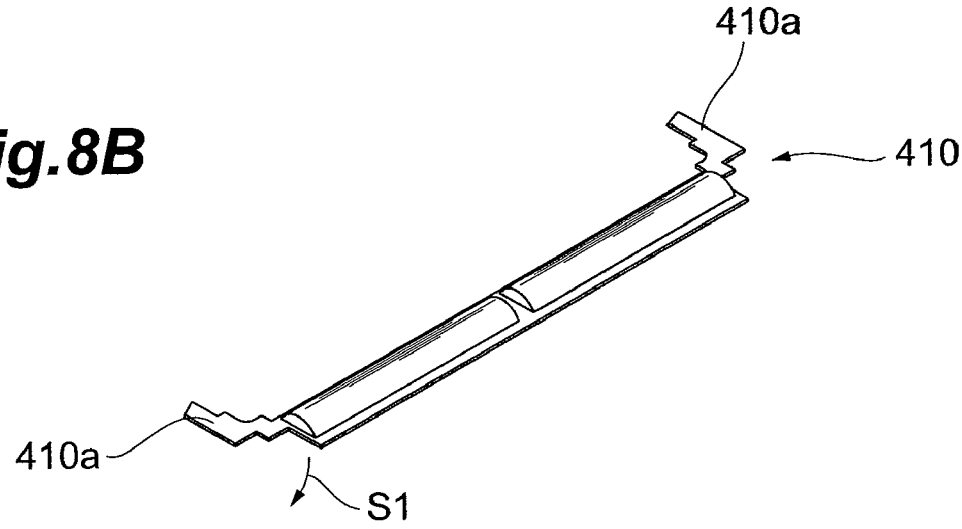
Figure 8C:
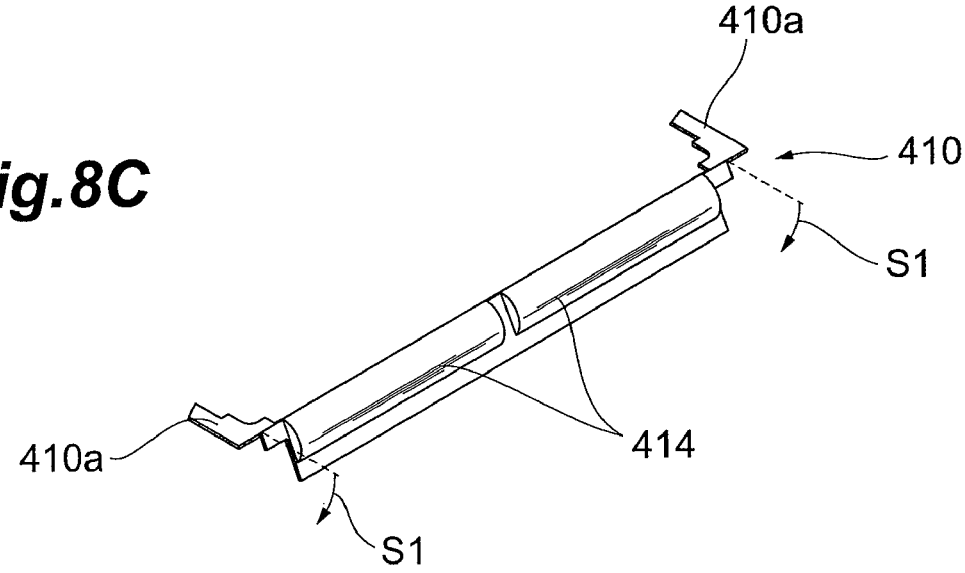

Here, the plurality of dynodes 414, both ends of each of which are supported by the pair of supports 410*a*, are formed integral to the pair of supports 410*a* as shown in FIGS. 8A to 8C and constitute a part of the supporting frame 410.

That is, the supporting frame 410 and a plate portion that is to become dynodes are cut out integrally from a single metal plate as shown in FIG. 8A. In the plate portion, both ends of which are connected to the supporting frame 410, depressions that are to become the dynodes are formed additionally by pressing. Specifically, two depressions are formed adjacently as shown in FIG. 8B, and these depressions become two mutually adjacent electron multiplier channels. The plate portion, in which the two dynodes have been formed, is then bent in a direction indicated by an arrow S1 to obtain the dynodes 414 integrally held by the supporting frame 410 (FIG. 8C).

Figure 9A:
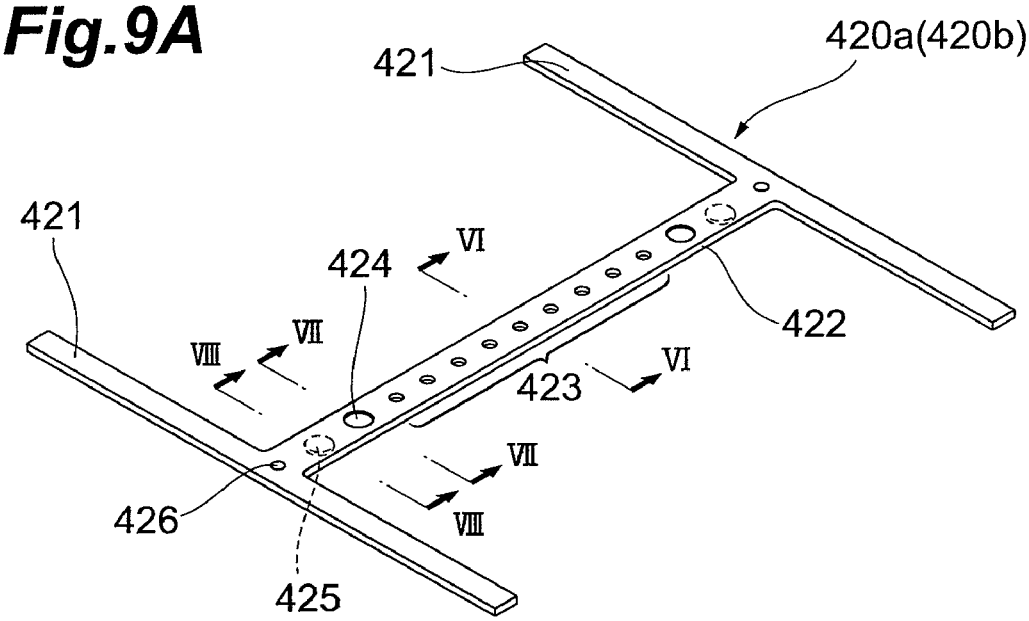
FIGS. 9A to 9D are a perspective view and sectional views for describing a configuration of an insulating spacer positioned between dynode units.

FIGS. 9A to 9D are a perspective view and sectional views for describing a configuration of the insulating spacer 420 disposed between the dynode units. In particular, FIGS. 9A to 9D show a structure of the spacer element 420*a* (420*b*) that constitutes the insulating spacer 420, and as shown in FIG. 9A, the spacer element 420*a* (420*b*) has an H shape like the supporting frame 410. That is, the spacer element 420*a* (420*b*) constitutes a pair of supports 421, associated to the pair of supports 410*a* of the supporting frame 410, and a connecting portion 422, associated to the connecting portion 410*b* of the supporting frame 410.

Figure 9B:
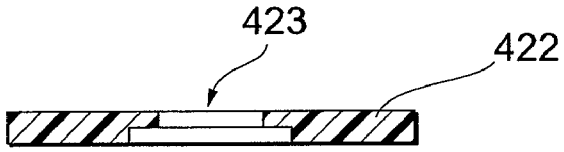
Figure 9D:
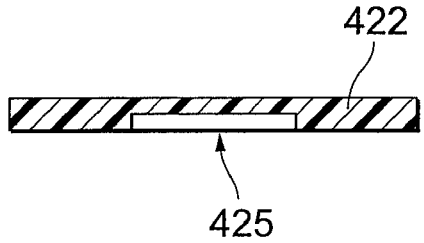
Figure 9C:
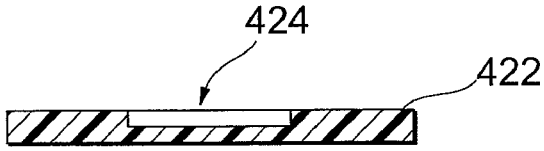

In the connecting portion 422 of the spacer element 420*a* (420*b*), through holes 423 and 426 are formed at positions corresponding to the through holes 411 and 415 of the connecting portion 410*b* of the supporting frame 410. The connecting portion 422 also has formed therein embosses 424 for positioning with respect to the supporting frame 410, and embosses 425 for positioning with respect to the supporting frame of the dynode unit positioned below. Here, when the insulating spacer 420 is formed by stacking a plurality of the spacer elements, the embosses 424 and 425 do not function. FIG. 9B shows a sectional structure of the through hole 423 in the connecting portion 422 taken on line VI-VI in FIG. 9A, FIG. 9C shows a sectional structure of the emboss 424 in the connecting portion 422 taken on line VII-VII in FIG. 9A, and FIG. 9D shows a sectional structure of the emboss 425 in the connecting portion 422 taken on line VIII-VIII in FIG. 9A.

Figure 10A:
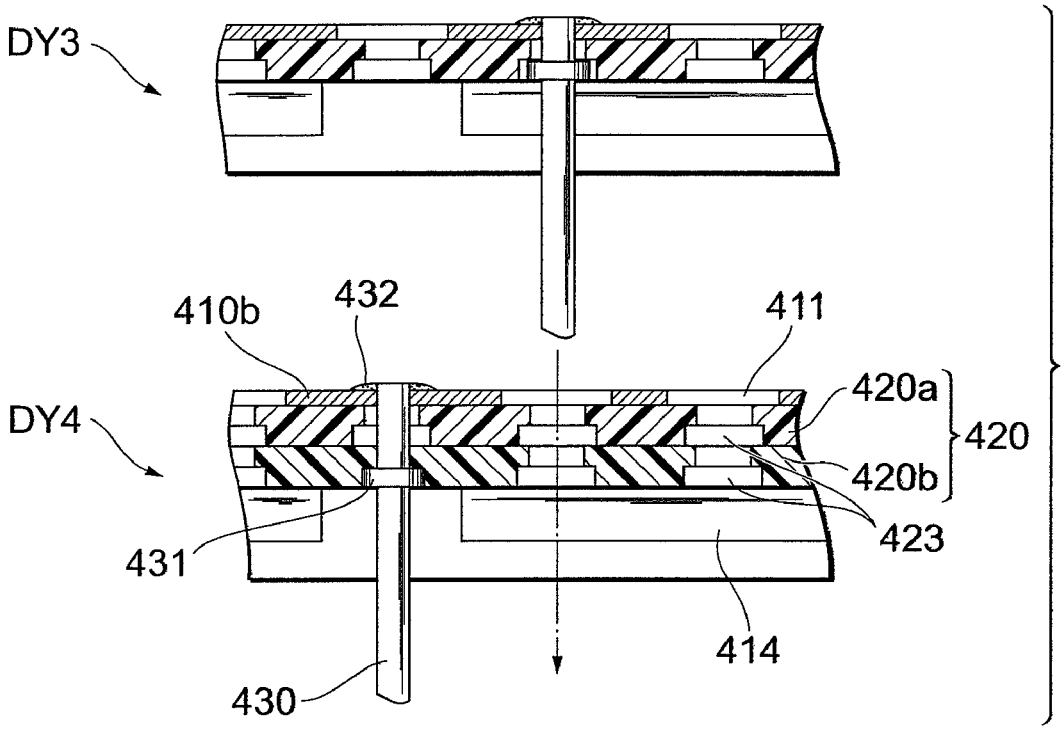
FIGS. 10A and 10B are sectional views for describing a stacked structure of the dynode units.
Figure 10B:
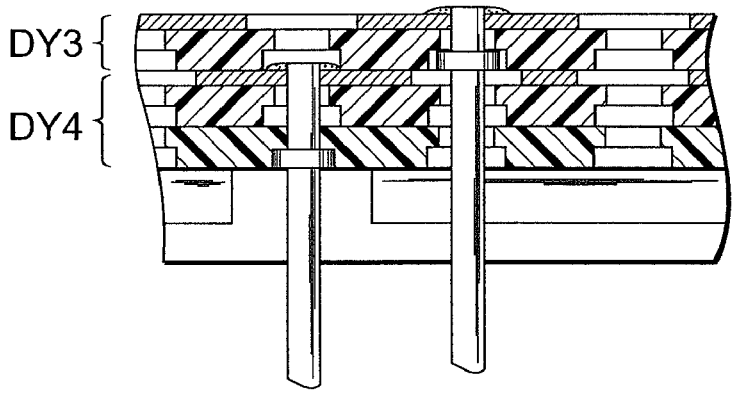

FIGS. 10A and 10B are sectional views for describing a stacked structure of the dynode units. As described above, the dynode units DY1 to DY8 of the respective stages each include: the supporting frame 410, holding the plurality of dynodes 414; the insulating spacer 420; and the dynode pin 430, having one end weld-connected to the supporting frame 410 by a solder 432. When the elements 410, 420, and 430 are assembled integrally, the dynode pin of the dynode unit positioned at an upper stage is inserted into the through hole of the dynode unit positioned immediately below as shown in FIG. 10A. By successively repeating this process, the stacked structure of the dynodes units is obtained as shown in FIG. 10B. In FIGS. 10A and 10B, the third stage dynode unit DY3 is shown as the dynode unit of the upper stage, and the fourth stage dynode unit DY4 is shown as the dynode unit immediately below. In regard to the order of assembly of the respective dynode units, the insulating spacer 420 may be fixed to the supporting frame 410 after the supporting frame 410 and the one end of the associated dynode pin 430 have been fixed. In this case, a flange 431 of the dynode pin 430 is unnecessary.

Here, a step is formed in the through hole 423 of each of the spacer elements 420*a* and 420*b* that constitute the insulating spacer 420. Meanwhile, the flange 431, contacting the step formed in the through hole 423 of the spacer 420*b* (the spacer element of the lowermost layer in a case where a plurality of spacer elements are stacked), is disposed on the dynode pin 430 associated to the dynode unit of each stage. The position of the associated dynode pin 430 along the direction directed from the photocathode 200 to the anode unit 500 is thus defined by the step. Also, when the one end of the dynode pin 430 is fixed to the supporting frame 410 (the connecting portion) in the state where the flange 431 contacts the step of the spacer element 420*b*, the entire insulating spacer 420 is pressed against the supporting frame 410 by the flange 431. By such cooperation of the step formed in the through hole 423 of the spacer element 420 and the dynode pin 430, a structure for fixing the entire insulating spacer to the supporting frame 410 and a structure for positioning the dynode pin 430 are realized.

Figure 11A:
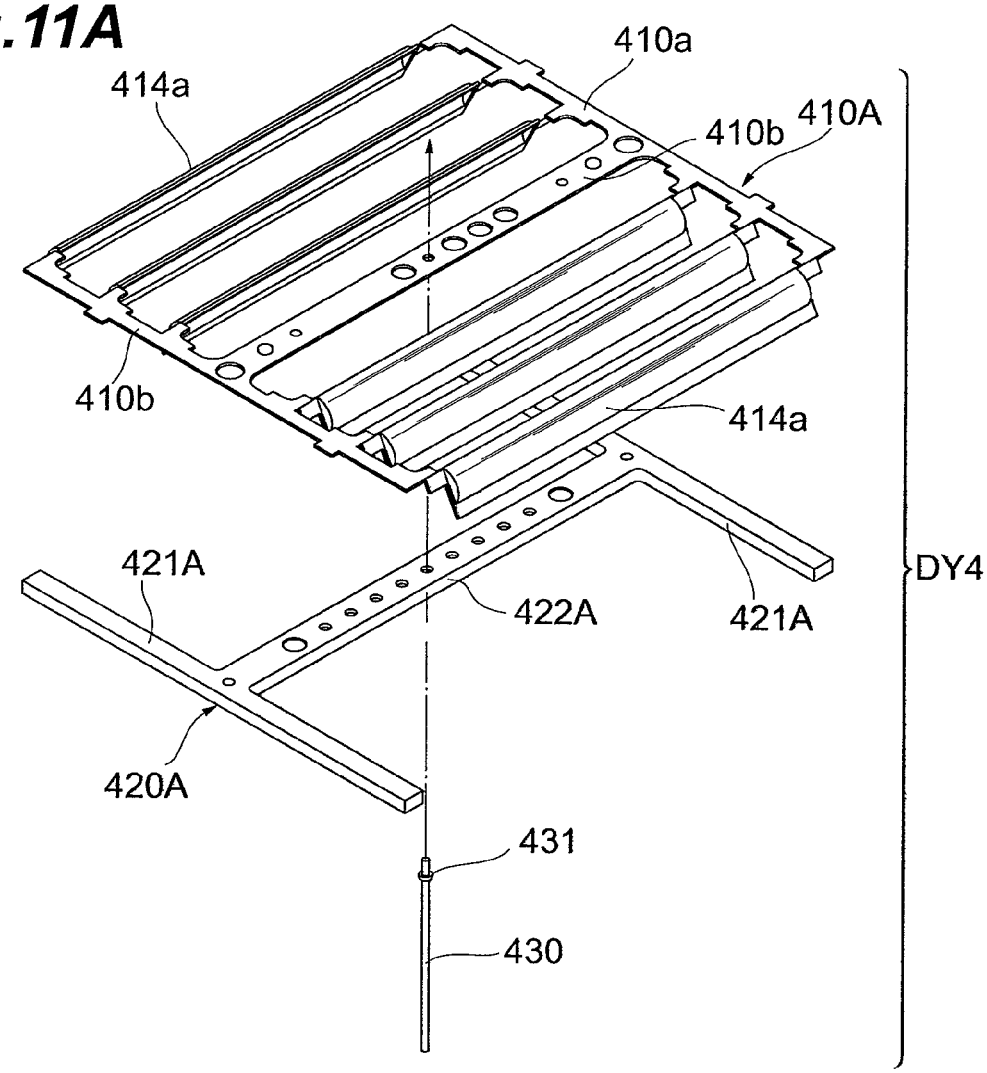
FIGS. 11A and 11B are an assembly process diagram and sectional views for describing a second configuration of a fourth stage dynode unit that constitutes a part of the electron multiplier section.
Figure 11B:
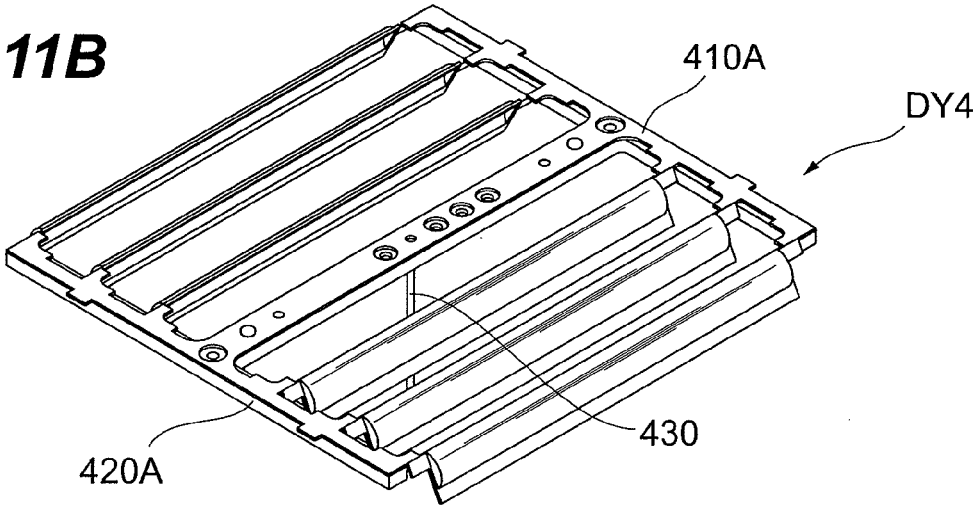
Figure 12A:
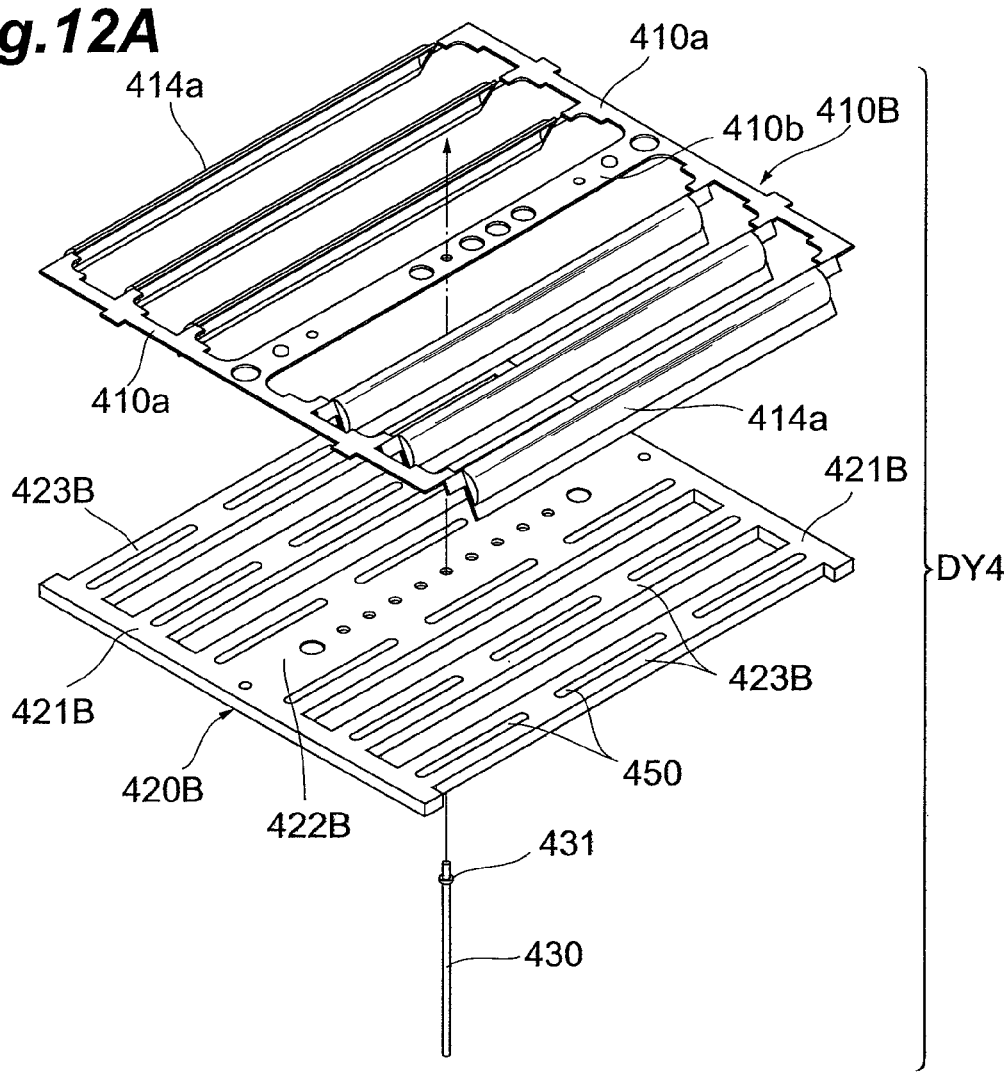
FIGS. 12A and 12B are an assembly process diagram and sectional views for describing a third configuration of a fourth stage dynode unit that constitutes a part of the electron multiplier section.
Figure 12B:
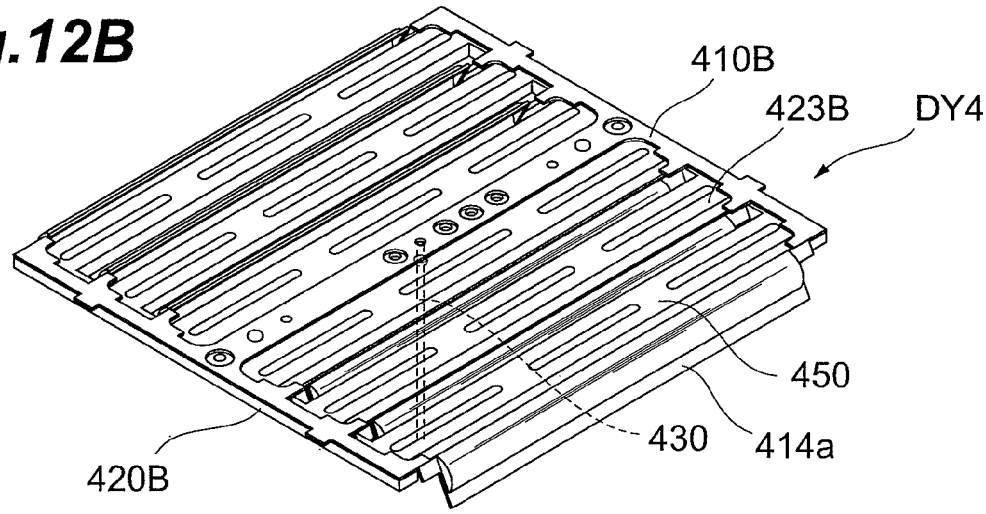

A configuration of dynode unit is not limited to the above-described configurations, but can be modified in various manners. For example, FIGS. 11A and 11B are an assembly process diagram and sectional views for describing a second configuration of a fourth stage dynode unit that constitutes a portion of the electron multiplier section. In addition, FIGS. 12A and 12B are an assembly process diagram and sectional views for describing a third configuration of a fourth stage dynode unit that constitutes a portion of the electron multiplier section. In the following, as second and third configurations, the fourth stage dynode unit DY4 will be referred.

As shown in FIG. 11A, the fourth stage dynode unit DY4 according to the second configuration comprises a supporting frame 420A holding a plurality of dynodes 414*a*, an insulating spacer 420A, and a dynode pin 430. The supporting frame 410A is constituted by a pair of supports 410*a* disposed so as to sandwich all dynodes 414*a*, and a connection portion 410*b* with both ends fixed to the pair of supports 410*a* and being set to the same potential as the supports 410*a*. As compared with the supporting frame 410 according to the first configuration shown in FIG. 7A, the second configuration differs from the first configuration in a dynode shape to be held. In other words, in the supporting frame 410 according to the first configuration, both two dynodes 414 are held by the pair of supports 410*a*. On the other hand, in the supporting frame 410A, one dynode 414*a* is held by the pair of supports 410*a*.

The insulating spacer 420 in the second configuration, similar to the insulating spacer 420 in the first configuration, has potions 421A and 422A corresponding to the supports 410*a* and the connecting portion 410*b* that constitutes the supporting frame 410A. Here, though the insulating spacer 420 in the first configuration is constituted by the spacers elements 420*a* and 420*b*, the insulating spacer 420A is constituted by a single member.

In addition, the dynode pin 430 has the same configuration as the first and second configurations. That is, in such a second configuration, the dynode pin 430 is provided with an alignment flange 431. The fourth stage dynode unit DY4, as shown in FIG. 11B, can be obtained by fixing one end of the dynode pins 430 to the supporting frame 410A through the through hole provided in the connecting portion 422A of the insulating spacer 420A in the sate of overlapping the supporting frame 410A and the insulating spacer 420A. In this time, the supporting frame 410A and the dynode pin 430 are electrically connected to each other.

Next, a dynode unit according to the third configuration (FIGS. 12A and 12B show only fourth stage dynode unit DY4), similar to the first and second configurations, also comprises a supporting frame 410B holding a plurality of dynodes 414*a*, an insulating spacer 420B, and a dynode pin 430. The supporting frame 410B in the third configuration has the same configuration as the supporting frame 410A in the second configuration. Here, the insulating spacer 420B in the third configuration, similar to the second configuration, portions 421B corresponding to the pair of supports 410*a* in the supporting frame 410B and a portion 422B corresponding to the connecting portion 410*b*, but the third configuration differs from the second configuration in the point of further comprising a plurality of light shielding portions 423B disposed so as to plaster the openings positioned between the dynodes 414*a*. Also, each of the plurality of light shielding portions 423B is provided with a plurality of slits 450. By this configuration, the light shielding portions 423B function to shield light propagating from the anode side to the photocathode side, and, on the other hand, each of the slits 450 functions to pass an alkali metal vapor for photocathode formation therethrough from the anode side to the photocathode side. As described above, the dynode unit according to the second configuration (FIGS. 7A to 7D) and the dynode unit according to the third configuration differ in a configuration of insulating spacer.

In such a third configuration, the dynode pin 430 also has the same configuration as the first and second configuration. In other words, in the third constitution, the dynode pin 430 is provided with an alignment flanges 431. The fourth stage dynode unit DY4, as shown in FIG. 12B, can be obtained by fixing one end of the dynode pins 430 to the supporting frame 410A through the through hole provided in the connecting portion 422A of the insulating spacer 420A in the sate of overlapping the supporting frame 410A and the insulating spacer 420A. At this time, the supporting frame 410A and the dynode pin 430 are electrically connected to each other. Also, by the light shielding portions 423B in the insulating spacer 420B, the openings positioned between the dynodes 414*a* are plastered.

Figure 13:
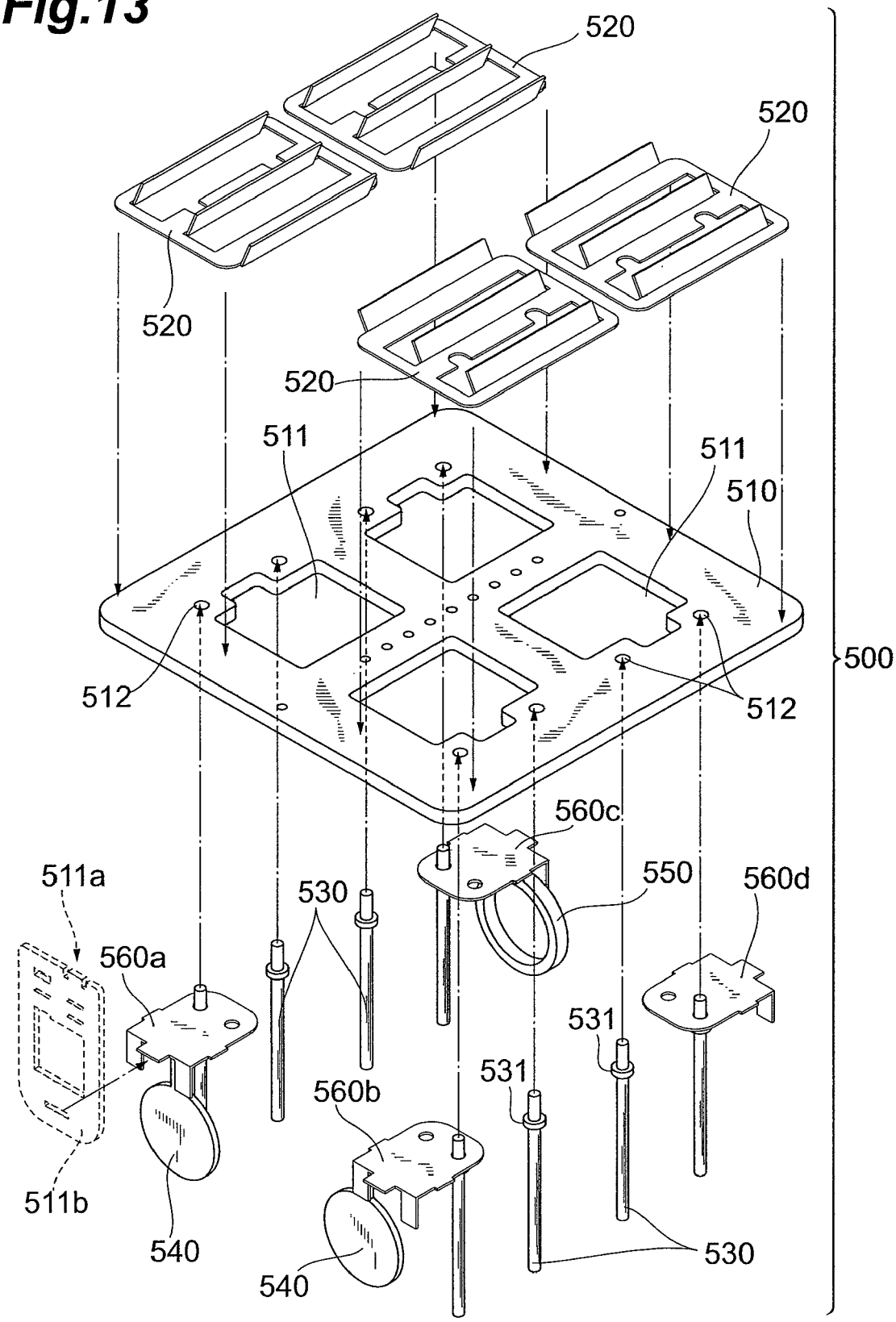
FIG. 13 is an assembly process diagram for describing a first configuration of the anode unit.

FIG. 13 is an assembly process diagram for describing a first configuration of the anode unit.

As shown in FIG. 13, the anode unit 500 includes: the ceramic substrate 510; the plurality of anode electrodes 520, disposed on the ceramic substrate 510; and the lead pins 530 (anode pins), the one ends of which are respectively fixed while being electrically connected to the anode electrodes 520. In the ceramic substrate 510, openings 511 are formed in correspondence to the positions of the anode electrodes 520, and through holes 512 are formed for supporting and letting portions of the anode pins 530 pass through. On a rear surface of the ceramic substrate 510 are disposed auxiliary members 560*a* to 560*d* for mounting the other ends of the side wall substrate members 510*a* to 510*d* to the anode unit 500. Furthermore, alkali source pellets 540, for forming the secondary electron emitting surfaces of the cathode 200 and the dynodes, are mounted on the auxiliary members 560*a* and 560*b*, and a getter 550 is mounted on the auxiliary member 560*c*. To assemble the anode unit 500, the lead pins 530, having the flanges 531, are penetrated through the respective through holes with the anode electrode 520, the ceramic substrate 510, and the auxiliary members 560*a* to 560*b* being overlapped sequentially. Here, by welding the anode electrodes 520 and the one ends of the anode pins 530 or by crimping the ends of the anode pins 530 on the upper surfaces of the anode electrodes 520, the anode pins 530 are fixed to the anode electrodes 520 via the ceramic substrate 510 and the auxiliary members 560*a* to 560*d*. By the ends of the anode pins 530 being fixed to the anode electrodes 520, the flanges 531 disposed on the anode pins 530 function to press the ceramic substrate 510 and the auxiliary members 560*a* to 560*d* against the anode electrodes 520.

In FIG. 13, only the side wall substrate member 510*a* among the side wall substrate members 510*a* to 510*d* is shown (illustration of the side wall substrate members 510*b* to 510*d* is omitted). A slit 511*b* is formed in the other end of the side wall substrate member 510*a*. By the slit 511*b* and a fixing tab of the auxiliary member 560*a* being joined after the focusing electrode unit 300, the electron multiplier section 400, and the anode unit 500 have been stacked as shown in FIG. 4, the side wall substrate member 510*a* functions to maintain the stacked structure. Although not illustrated, the remaining side wall substrate members 510*b* to 510*d* also have the same structure and function in the same manner as the side wall substrate member 510*a*.

Figure 14A:
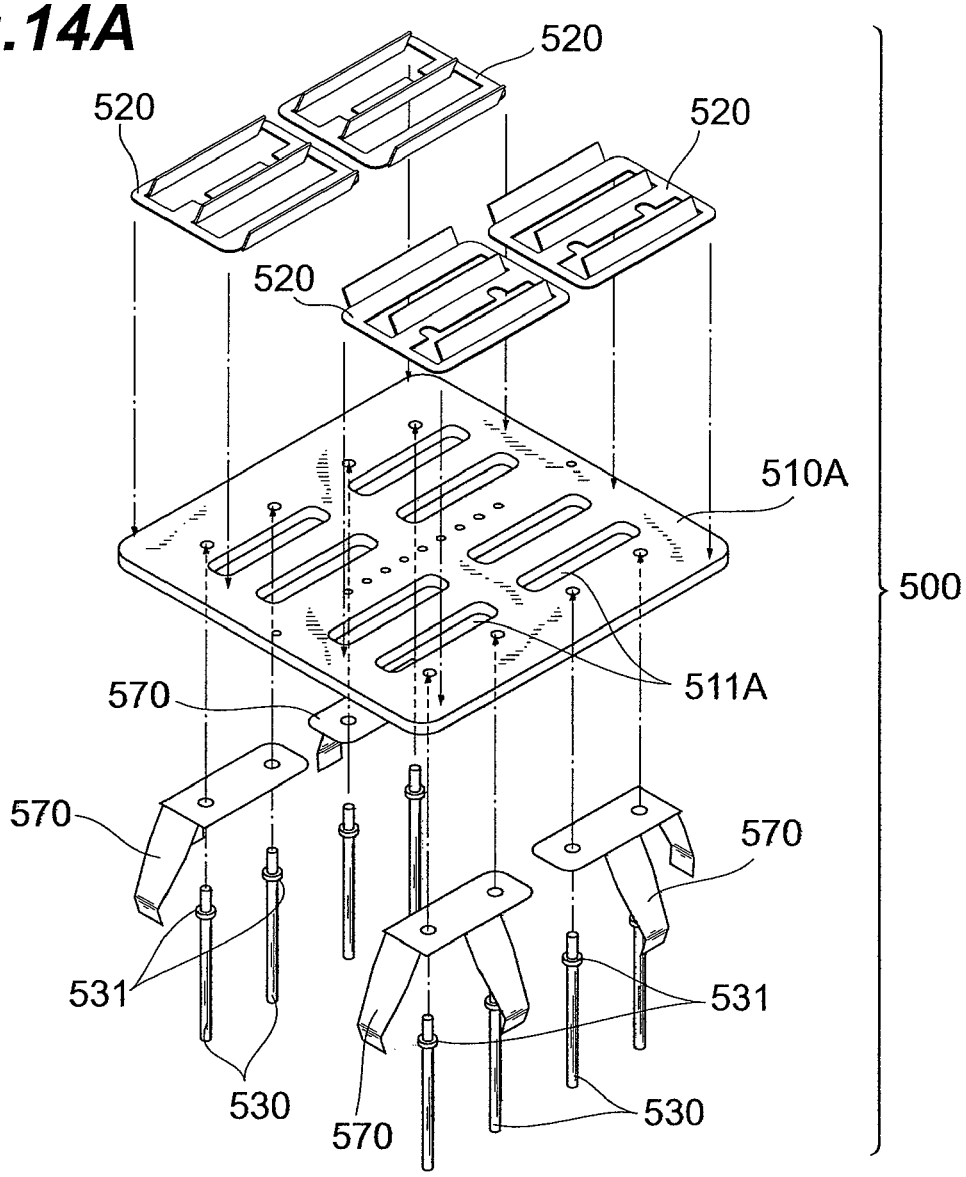
FIGS. 14A and 14B are assembly process diagrams for describing a second configuration of the anode unit.
Figure 14B:
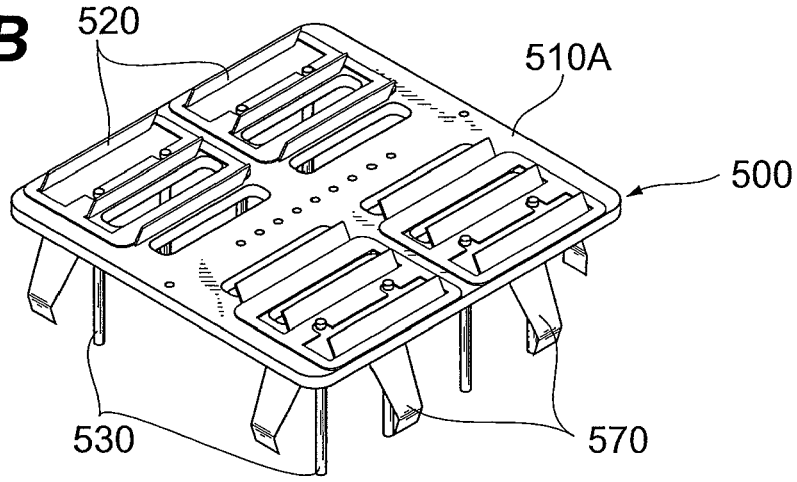

The anode unit 500 described above can be realized by various configurations. For example, FIGS. 14A and 14B are assembly process diagrams for describing a second configuration of the anode unit. In addition, FIGS. 15A and 15B are assembly process diagrams for describing a third configuration of the anode unit.

As shown in FIG. 14A, the anode unit 500 according to the second configuration a ceramic substrate 510A, a plurality of anode electrodes 520 to be provided on the ceramic substrate 510A, and lead pins (anode pin) 530 fixed to the anode electrodes 520 while one end of each lead pin 530 is electrically connected to the associated one of the anode electrodes 520. The ceramic substrate 510A is provided with openings 511A in according to the arrangement of the anode electrodes 520, and through holes for respectively passing and supporting the anode pins 520. Each of the anode pins 530 is provided with an alignment flange 531. In addition, unlike the first configuration, on the rear surface of the ceramic substrate 510A, spring members 570, which functions to maintain the setting position of the internal unit including the anode unit 500 inside the sealed container 100, are fixed.

To assemble the anode unit 500, in the state that the anode electrodes 520 and the ceramic substrate 510A the rear surface of which the spring members 570 are attached are overlapped, let the anode pins 530 each having a flange 531 penetrate through the through holes thereof. At this time, the anode pins 530 are fixed to the anode electrodes 520 through the ceramic substrate 510A, by welding one end of the anode pin 530 to the associated anode electrode 520 or crimping the end of the anode pin 530, on the upper surface of the associated anode electrode 520. The flange 531 provided on each of the anode pin 530 functions to push the ceramic substrate 510A to the anode electrodes 520 by fixing the anode pins 530 to the associated anode electrodes 520. The anode unit 500 according to the second configuration, as shown in FIG. 14B, can be obtained via the above assembling process.

Figure 15A:
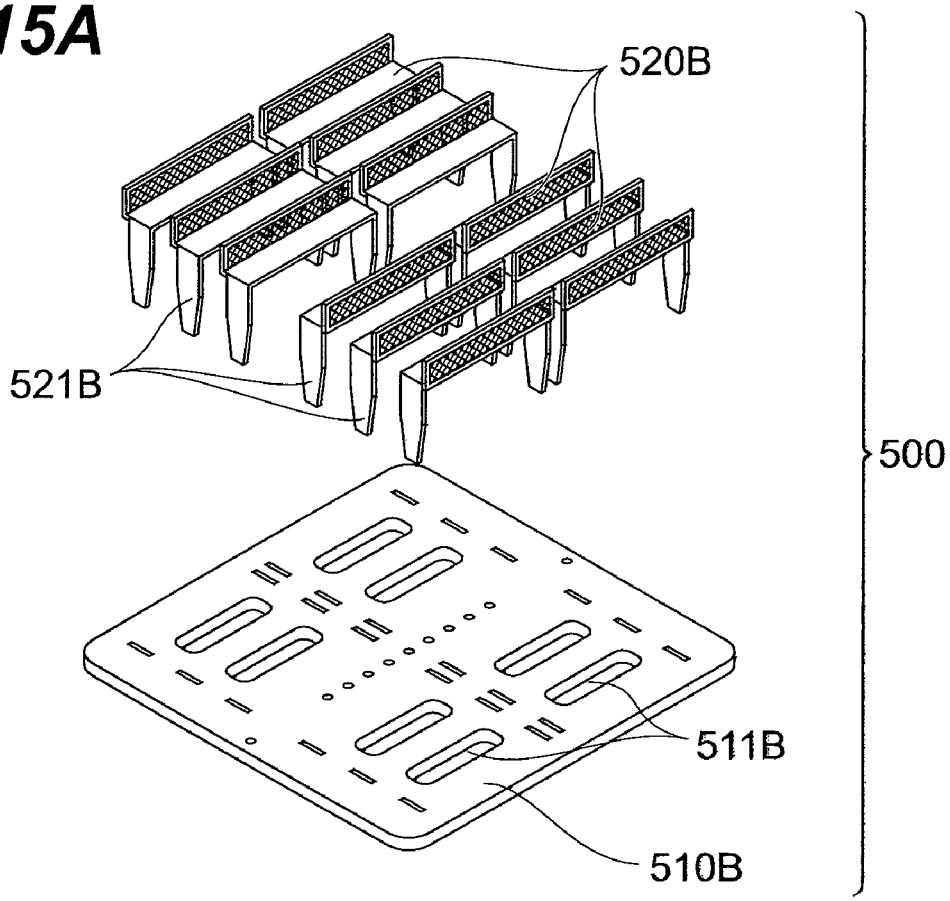
FIGS. 15A and 15B are assembly process diagrams for describing a third configuration of the anode unit.
Figure 15B:
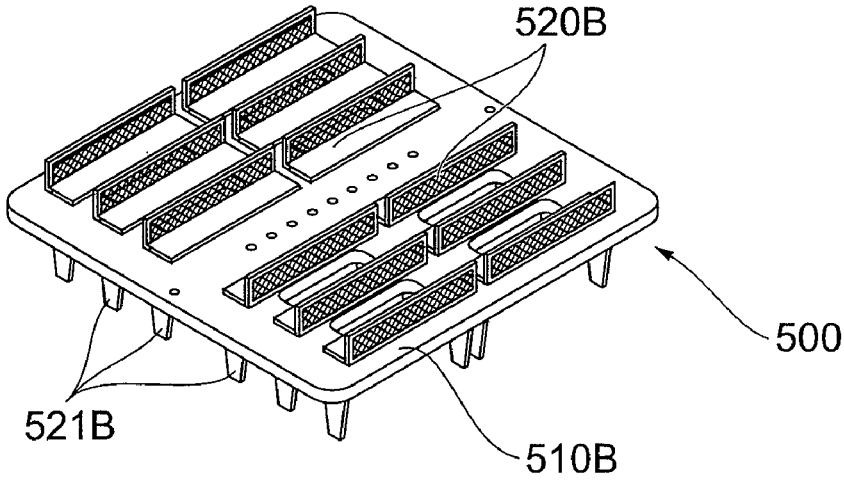

Next, the anode unit 500 according to the third configuration, as shown in FIG. 15A, can improve a linearity by reflecting type anode electrodes 520B provided.

In other words, the anode unit 500 according to the third configuration comprises a ceramic substrate 510B, and a plurality of reflecting type anode electrodes 520B provided with the ceramic substrate 50B. On both ends of each reflecting type anode electrode 520B, the electrode pieces 521B for electron output. Therefore, as shown in FIG. 15B, the anode unit 500 according to the third configuration can be obtained by inserting the electrode pieces 521B of each reflecting type anode electrode 520B into the slit-shaped through holes provided on the ceramic substrate 510B.

Figure 16A:
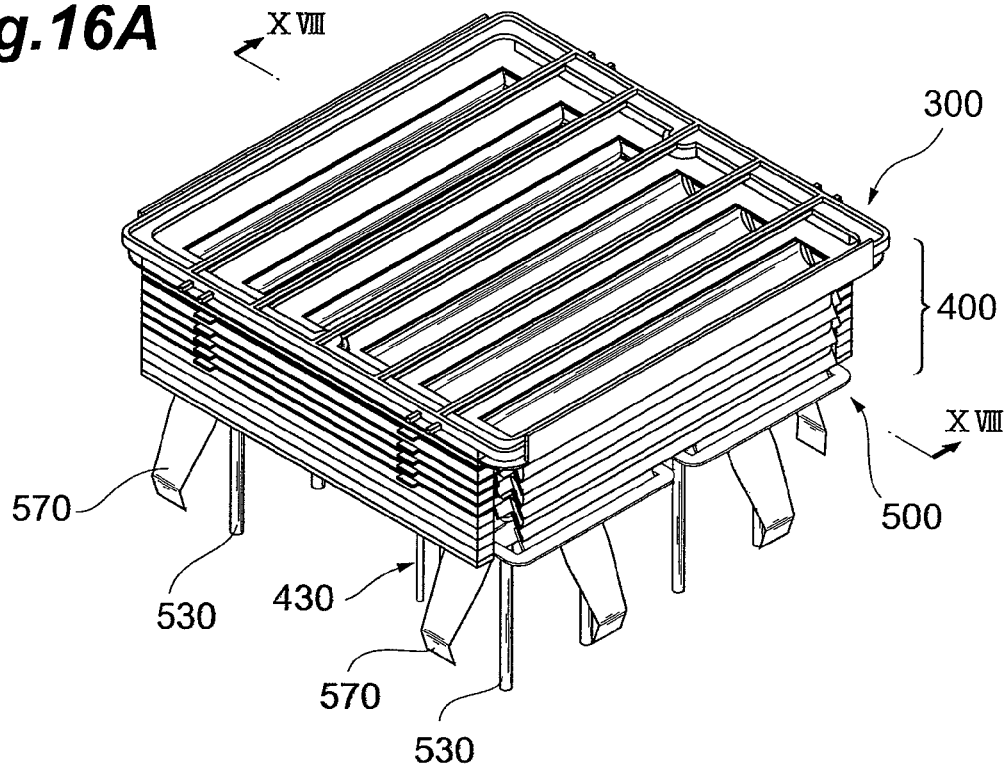
FIGS. 16A and 16B are schematic perspective views of an internal unit in which the focusing electrode unit of FIG. 6, the electron multiplier section of FIGS. 12A and 12B, and the anode unit
Figure 16B:
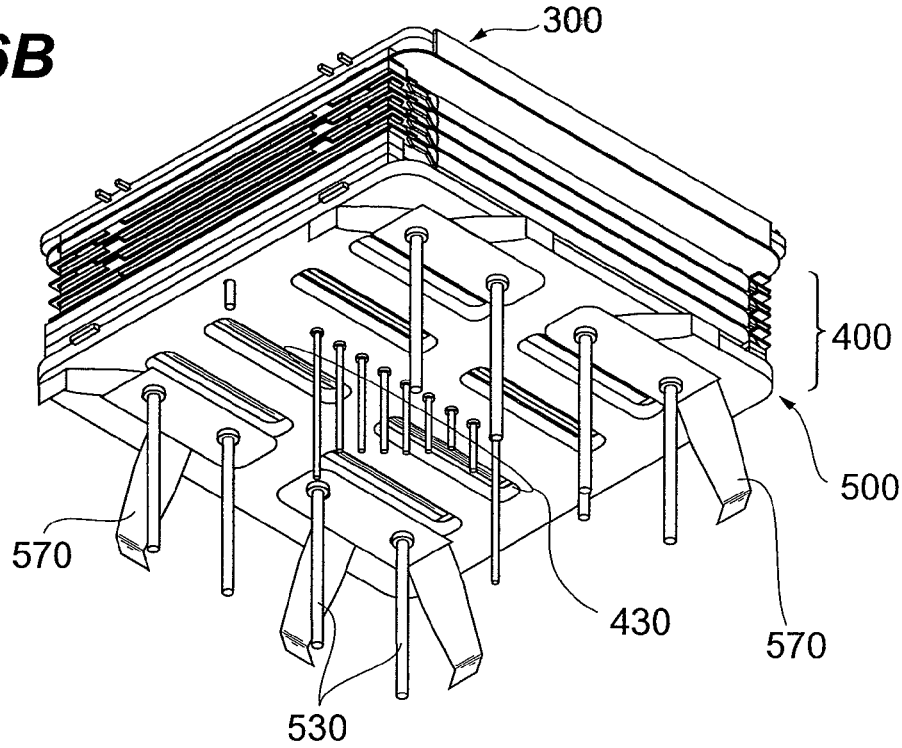

Each part constituting the internal unit housed in the sealed container 100 can be realized in the above various configurations. As an example, FIGS. 16A and 16B are schematic perspective views of an internal unit in which the focusing electrode unit of FIG. 6, the electron multiplier section of FIGS. 12A and 12B, and the anode unit FIGS. 14A and 14B are stacked integrally. In other words, FIG. 16A is a perspective view of an internal unit according to another configuration when the internal unit is viewed from the photocathode side, and FIG. 16B is a perspective view of an internal unit according to another configuration when the internal unit is viewed from the stem side.

Figure 17:
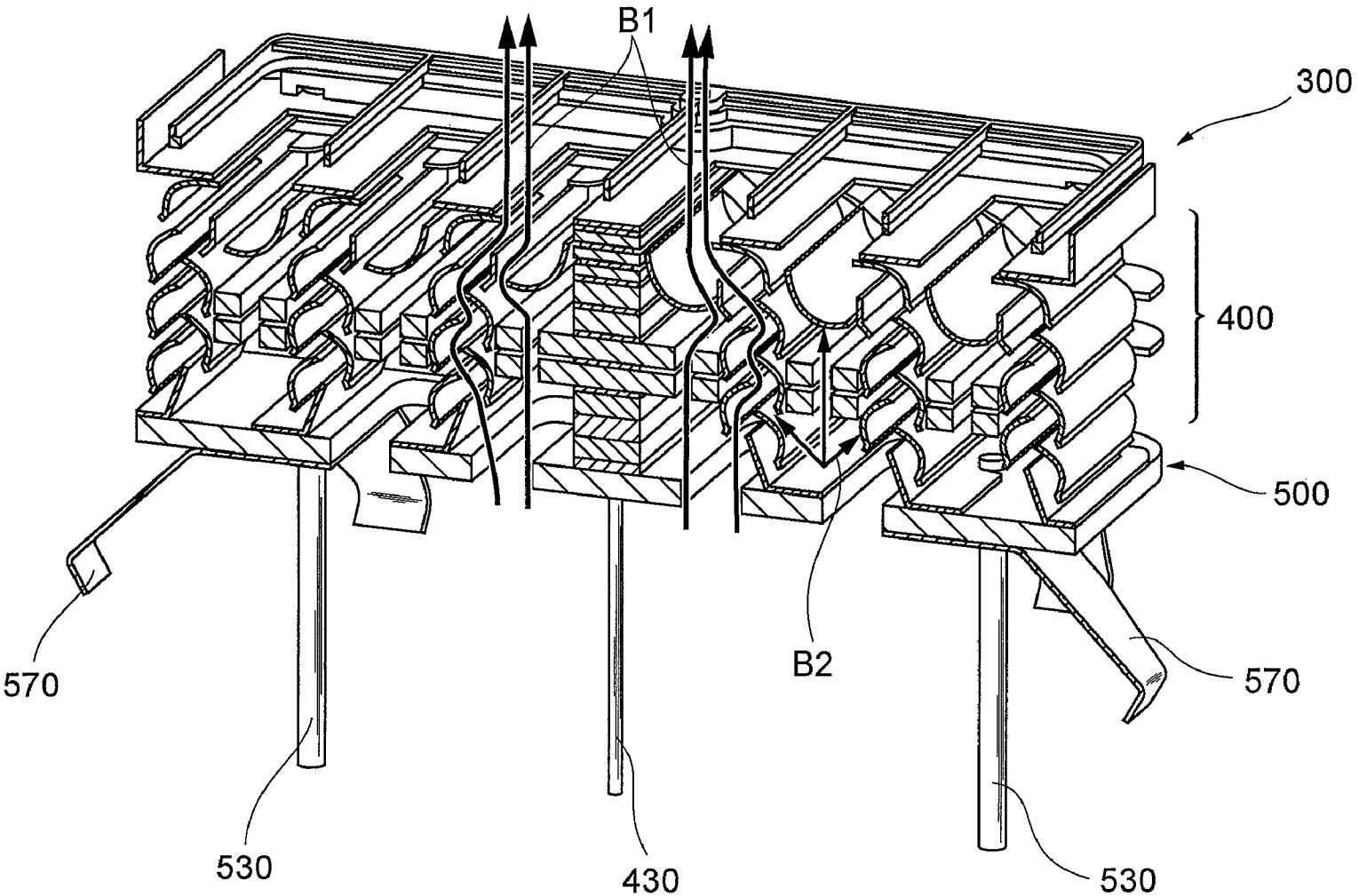
FIG. 17 is a diagram of a sectional structure taken on line XVIII-XVIII of the internal unit shown in FIGS. 16A and 16B.

In addition, FIG. 17 is a diagram of a sectional structure taken on line XVIII-XVIII of the internal unit shown in FIGS. 16A and 16B. Here, the dynode unit of FIGS. 12A and 12B comprises an insulating spacer 420B having a plurality of light shielding portions 423B each provided with a plurality of slits 450. The arrow B1 shown in FIG. 17 indicates propagation paths of alkali metal vapor passing through each stage dynode unit from the stem side to the photocathode side. On the other hand, the arrow B2 indicates propagation paths of light generated near the anode electrodes 520. As shown in FIG. 17, in the insulating portion 420B constituting each stage dynode unit, the light shielding portions 423B disposed so as to plaster the openings positioned between the dynodes 414*a* shields most of light generated near the anode electrodes 520. In addition, light passing through the slits 450 provided in each light shielding portion 423B is also shielded by the dynodes 414*a* positioned at the upper stage. On the other hand, the alkali metal vapor directing from the stem side to the photocathode side smoothly flows by the structure in which the stage dynode units are stacked while being separated at a predetermined distance and the structure in which a plurality of slits 450 are provided in each light shielding portion 423B.

Figure 18A:
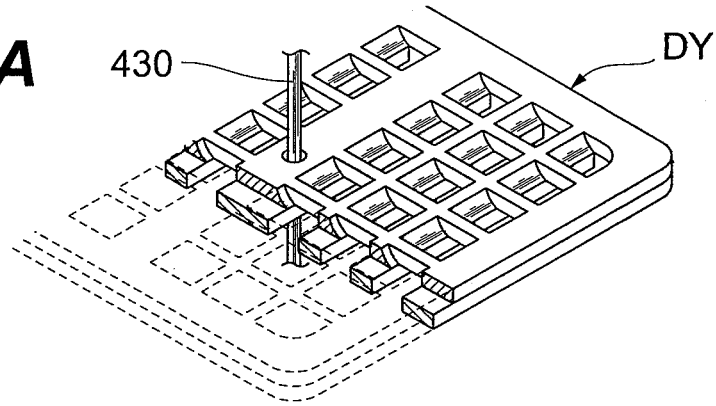
FIGS. 18A to 18C are partially broken-away views for describing various dynode structures applicable to a dynode unit.
Figure 18B:
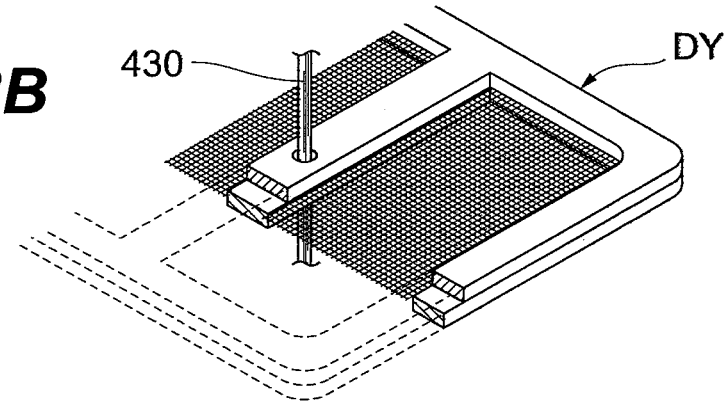
Figure 18C:
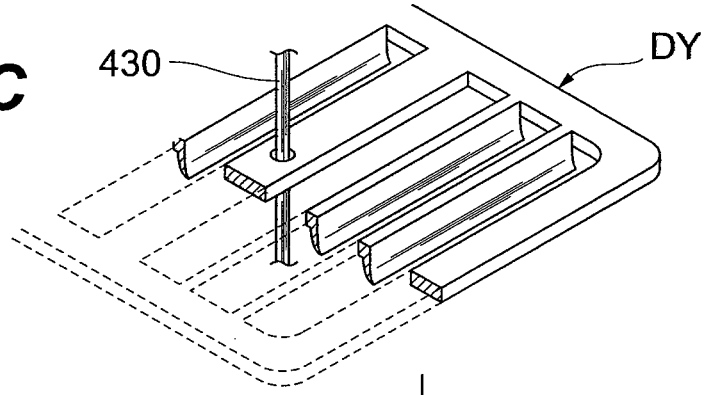

Although in the above-described embodiment, each of the dynodes held by the dynode units DY1 to DY8 of the respective stages has a line focus shape, the dynode shape is not restricted to the line focus shape. For example, a dynode unit DY shown in FIG. 18A is a metal channel plate formed by adhering together two metal plates, each having electron multiplier holes formed therein. In this case, the electron multiplier holes formed in the metal channel plates correspond to being the dynodes held by the dynode unit DY. A dynode unit DY shown in FIG. 18B has a structure in which a mesh electrode is sandwiched by two metal frames, each having openings. With the dynode unit DY shown in FIG. 18B, the opening portions of the metal frames function as mesh dynodes. In a dynode unit DY shown in FIG. 18C, a metal frame and dynodes held thereby are formed integrally by etching.

Figure 18D:
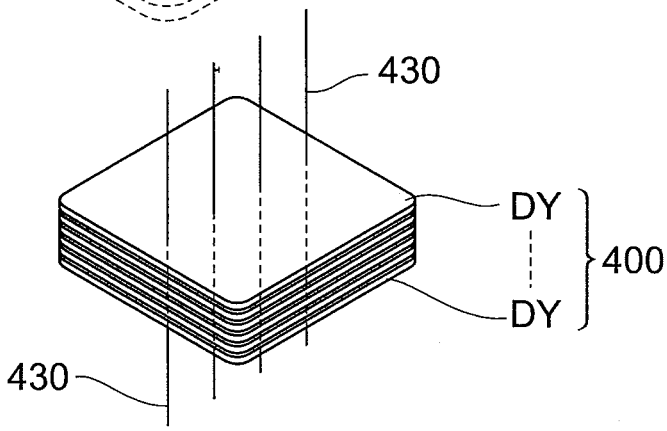
FIG. 18D is a conceptual diagram for describing structural features of the present invention.

As described above, the electron multiplier section 400 is obtained by the stacking of the multiple stages of the dynode units DY1 to DY8, in which various dynodes are held. When the dynode units DY1 to DY8 of the respective stages are stacked, the dynode pins associated to the dynode units DY1 to DY8 of the respective stages are disposed to penetrate through a space in which the dynodes 430 are disposed as shown in FIG. 18D. The space through which the lead pins 430 penetrate as viewed from the photocathode 200 side is the effective region of the electron multiplier section 400.

Figure 19A:
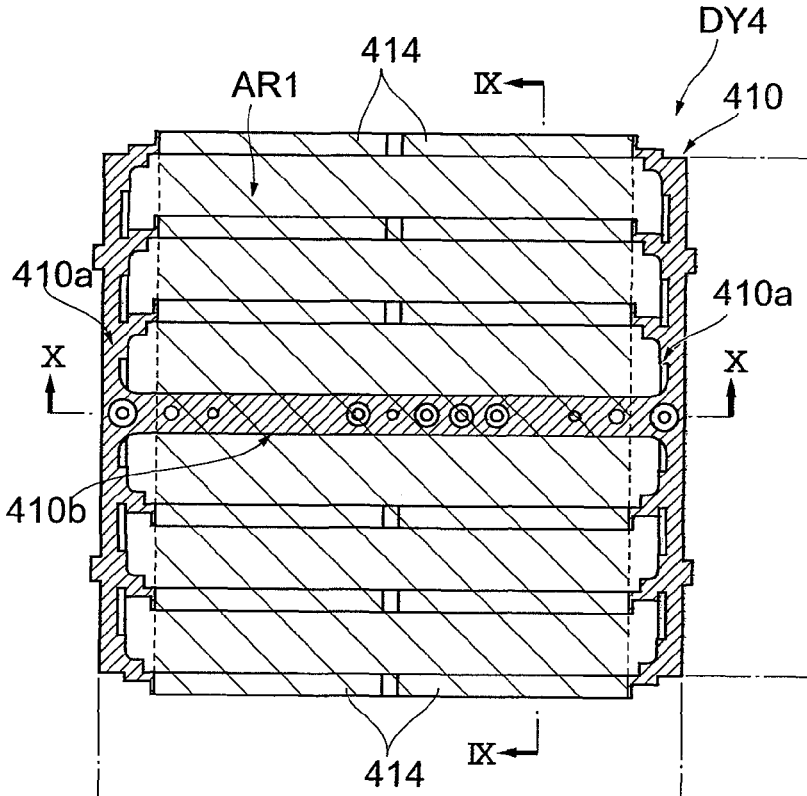
FIGS. 19A to 19C are a plan view and sectional views of a dynode unit for describing a structure of the dynode unit and an effective region of an electron multiplier section.
Figure 19B:
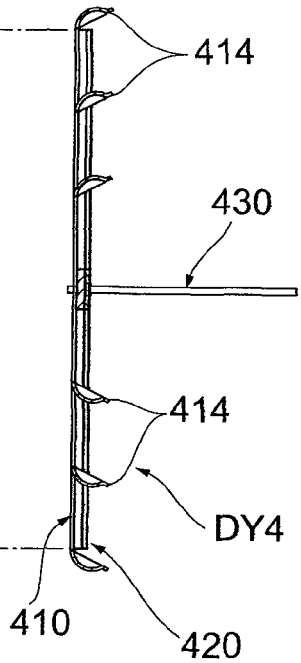
Figure 19C:
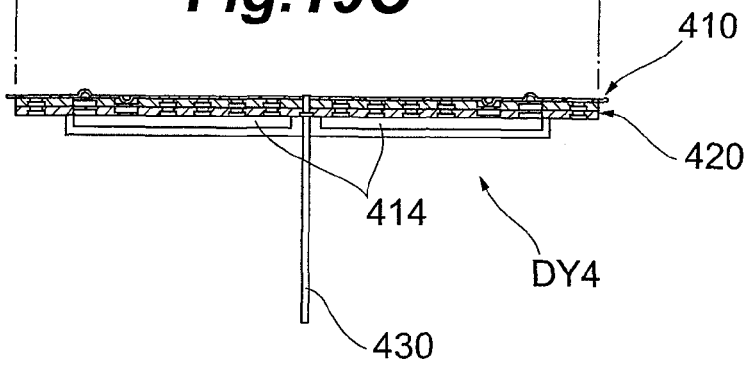

FIGS. 19A to 19C are a plan view and sectional views of the fourth stage dynode unit DY4 for describing the structure of the fourth stage dynode unit DY4 and the effective region of the electron multiplier section 400. As mentioned above, the dynode units DY1 to DY8 of the respective stages all have the same structure, and the fourth stage dynode unit DY4 is shown in FIGS. 19A to 19C as a representative unit. FIG. 19A is a plan view of the fourth stage dynode unit DY4 as viewed from the photocathode 200 side, FIG. 19B is a sectional view of the fourth stage dynode unit DY4 taken on line IX-IX in FIG. 19A, and FIG. 19C is a sectional view of the fourth stage dynode unit DY4 taken on line X-X in FIG. 19A.

As shown in FIG. 19A, the fourth stage dynode unit DY4 includes the supporting frame 410 holding the plurality of dynodes 414, with each of which one electron multiplier channels are formed (the same applies to the other dynode units DY1 to DY3 and DY5 to DY8). The effective region AR1 in the electron multiplier section 400 is the field region as viewed from the photocathode 200 side that contributes to secondary electron multiplication, and is defined as the photoelectron incidence surface of the electron multiplier section 400 on a plane orthogonal to the central axis AX of the bulb 120 in the sealed container 100. That is, the effective region is a minimum region that, when contours of all dynodes 414 included in the electron multiplier section 400 are projected onto the photoelectron incidence surface of the electron multiplier section 400, contains all projected components of the contours. A boundary line defining the effective region AR1 of the electron multiplier section 400 thus partially coincides with a portion of projected components of one of the dynode contours as shown in FIG. 19A.

Figure 20A:
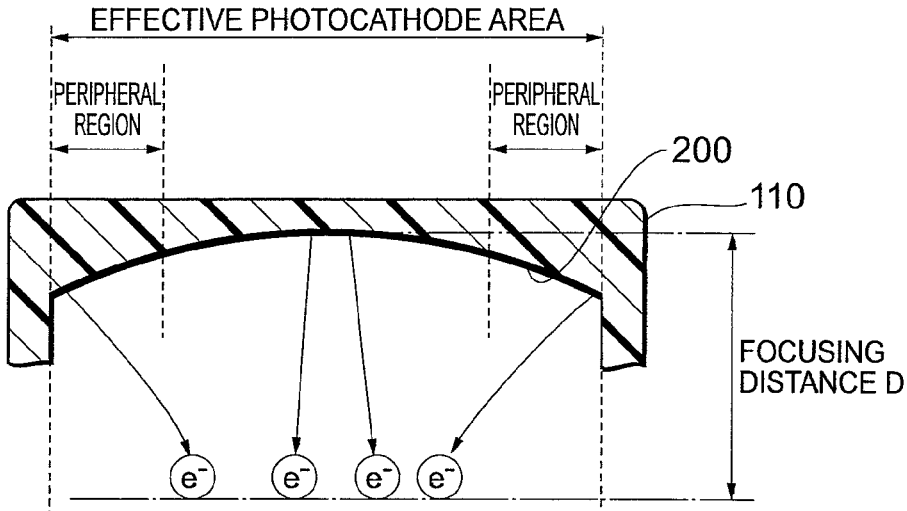
FIGS. 20A to 20C are conceptual diagrams for describing technical effects of the photomultiplier according to the present invention by comparison with a conventional art.
Figure 20B:
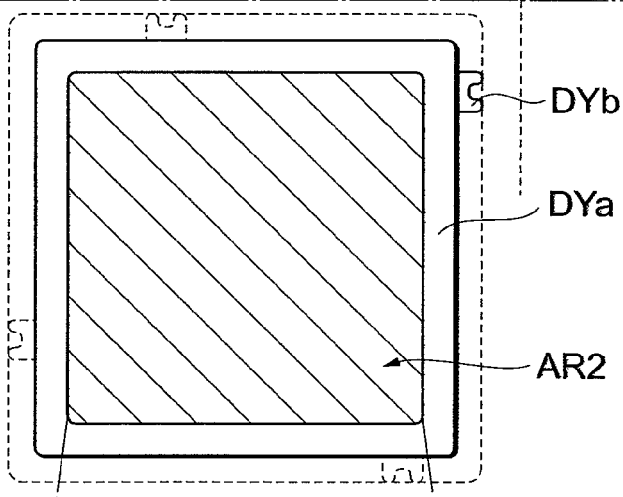

By the dynode pins 430 associated to the dynode units DY1 to DY8 of the respective stages being disposed inside the effective region AR1 of the electron multiplier section 400 shown in FIG. 19A, the following effects are provided. FIGS. 20A and 20B are conceptual diagrams for describing technical effects of the photomultiplier according to the present invention by comparison with a conventional art.

Normally, a peripheral region of a light exiting surface of the incidence surface plate 110, on which the photocathode 200 is formed, is processed to a curved surface as shown in FIG. 20A. Thus, in comparison to photoelectrons emitted from near a center of the photocathode 200, trajectories of photoelectrons emitted from the peripheral region are more greatly modified in a space defined by a focusing distance D. In this case, in a conventional photomultiplier, if an adequate focusing distance D cannot be secured, cascade multiplication of the photoelectrons emitted from the peripheral region of the photocathode 200 cannot be performed (the photoelectrons collide with the focusing electrode, etc., before reaching the first dynodes).

With the conventional photomultiplier, a dynode pin is fixed to a fixing tab DYb disposed along a periphery of an effective region of a electron multiplier section that avoids the effective region in which the dynodes are disposed, that is, specifically, at an outer periphery of a frame DYa that supports the dynodes as shown in FIG. 20B. The effective region AR2 of the electron multiplier section defined at an inner side of the frame DYa is thus restricted by just the dynode pin disposing space.

Figure 20C:
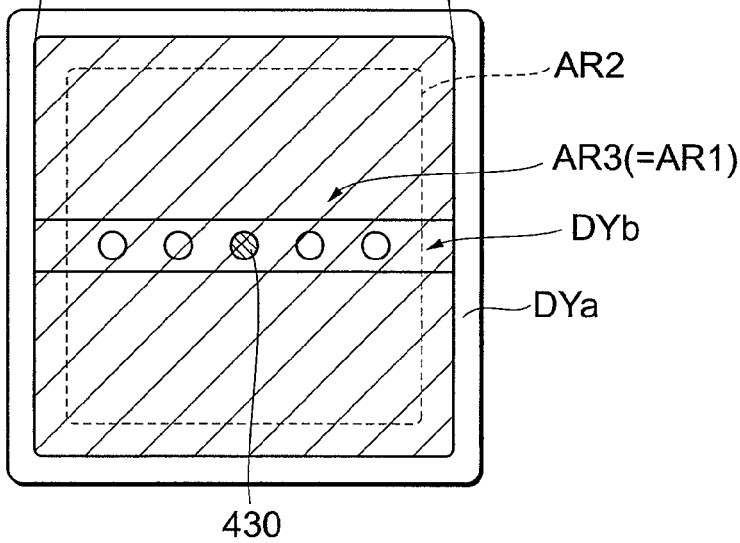

On the other hand, with the photomultiplier according to the present invention, because the dynode pins 430 are disposed inside an effective region AR3 (=AR1) of the electron multiplier section 400 as shown in FIG. 20C, it becomes possible to enlarge the effective region of the electron multiplier section in comparison to the conventional photomultiplier. By enlargement of the effective region AR3, trajectory modifications, especially of photoelectrons emitted from the peripheral region of the photocathode 200 opposing the photoelectron incidence surface of the electron multiplier section 400, are lessened in degree. The focusing distance D is thus reduced significantly (the photomultiplier can be made compact).

Figure 21A:
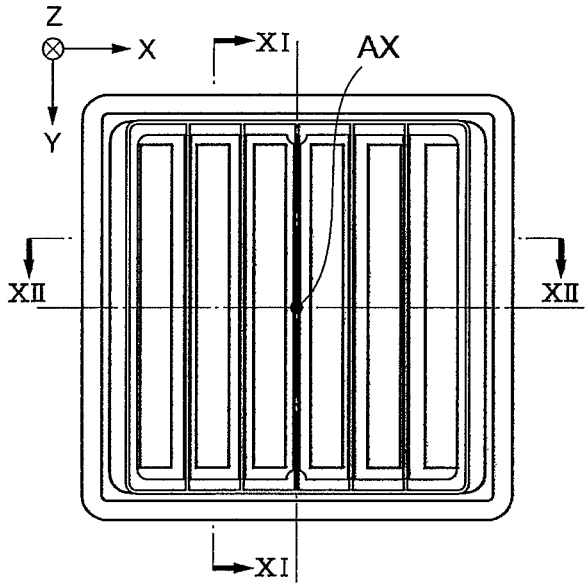
FIGS. 21A to 21C are diagrams for describing trajectories of photoelectrons emitted from a photocathode for describing structural characteristics and effects of the photomultiplier according to the present invention.
Figure 21B:
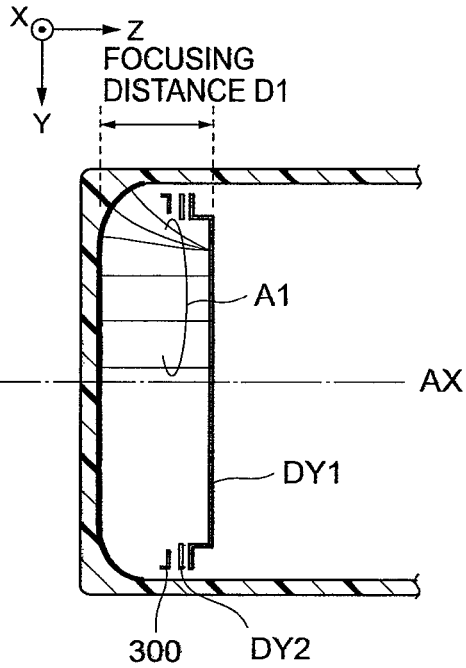
Figure 21C:
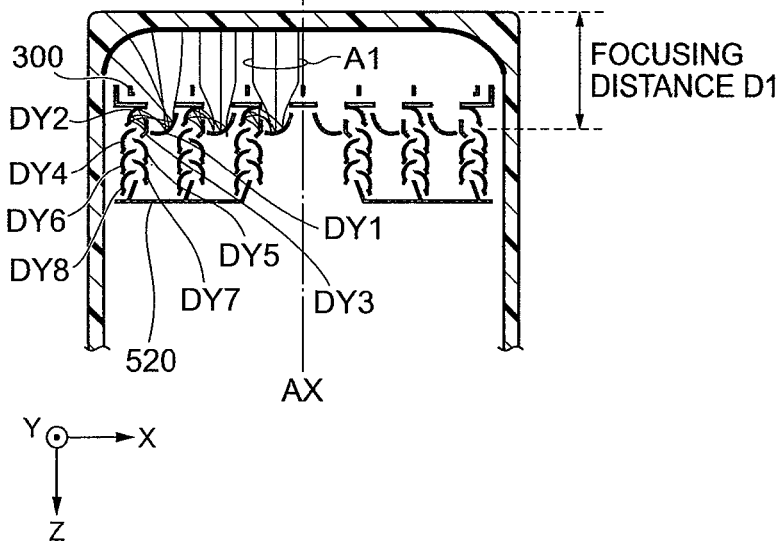

Effects of the above-described structural characteristics shall now be described more specifically using FIGS. 21A to 21C. FIGS. 21A to 21C are diagrams for describing trajectories of photoelectrons emitted from the photocathode 200 for describing the structural characteristics and effects of the photomultiplier according to the present invention. FIG. 21A is a plan view of the incidence surface plate 110 as viewed from the light incidence surface 110*a* side, and the effective region AR1 of the electron multiplier section 400 is enlarged to a degree such that it substantially coincides with an effective cathode area (practically coincident with the light exiting surface 110*b* in the incidence surface plate 110) of the incidence surface plate 110. Here as shown in FIG. 20A, the effective region of the electron multiplier section 400 is the field region as viewed from the photocathode 200 side that contributes to secondary electron multiplication, and is defined as the photoelectron incidence surface of the electron multiplier section 400 on the plane orthogonal to the central axis AX of the bulb 120 in the sealed container 100. FIG. 21B is a sectional view of the photomultiplier taken on line XI-XI shown in FIG. 21A, and FIG. 21C is a sectional view of the photomultiplier taken on line XII-XII shown in FIG. 21A.

Figure 22A:
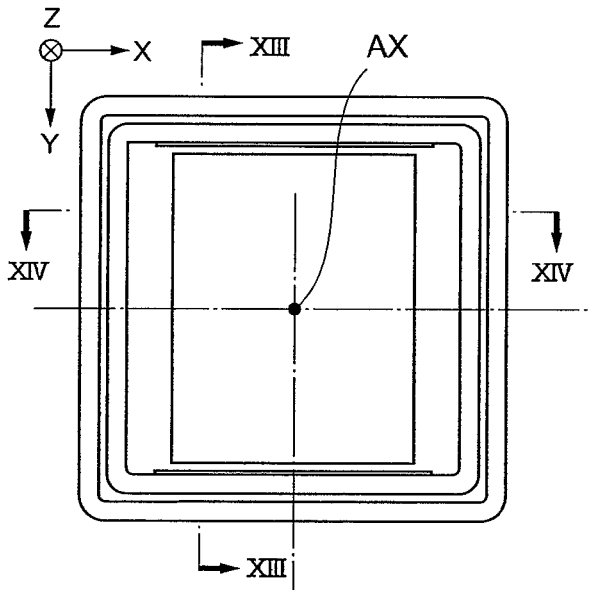
FIGS. 22A to 22C are sectional views, corresponding to FIGS. 21A to 21C, of a photomultiplier of a first comparative example prepared for describing the structural characteristics and effects of the photomultiplier according to the present invention and are diagrams for describing photoelectron trajectories in the photomultiplier according the first comparative example.
Figure 22B:
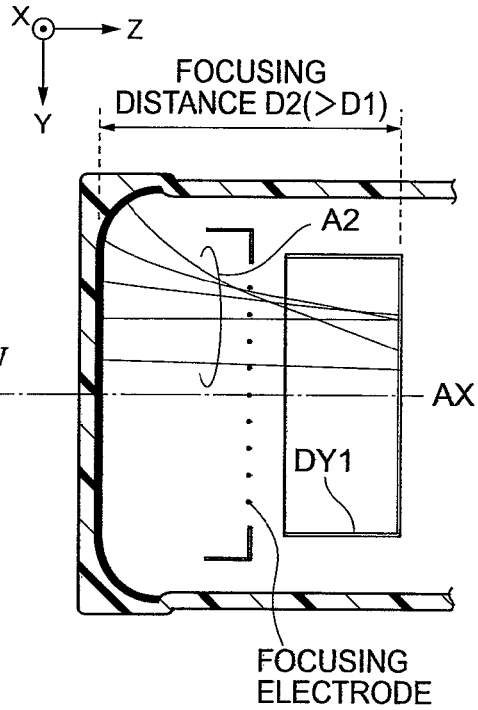
Figure 22C:
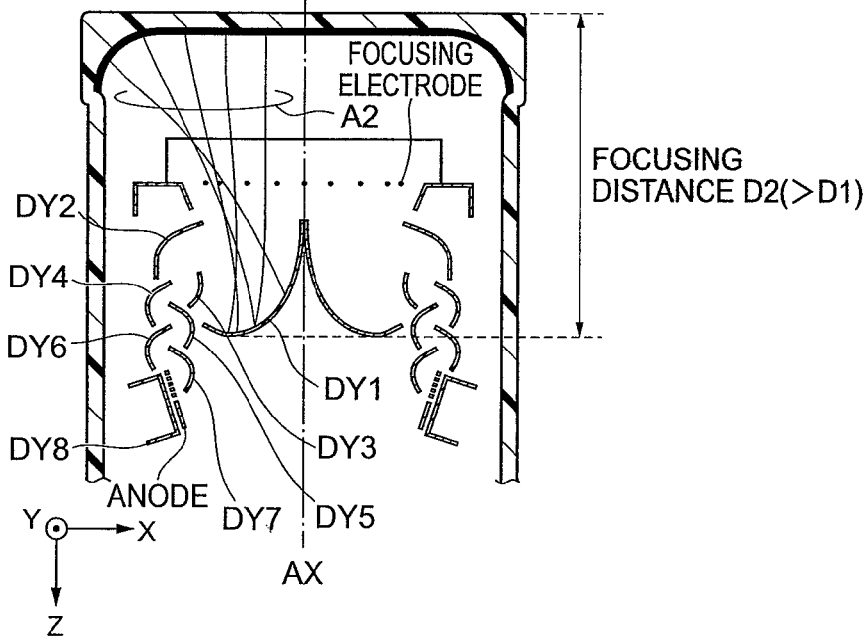

FIGS. 22A to 22C are sectional views, corresponding to FIGS. 22A to 22C, of a photomultiplier of a first comparative example prepared for describing the structural characteristics and effects of the photomultiplier according to the present invention and are diagrams for describing photoelectron trajectories A2 in the photomultiplier according the first comparative example. The prepared photomultiplier according to the first comparative example is a multichannel photomultiplier (four channels) having two first dynodes DY1 (two channels are disposed adjacently in each dynode) with back sides facing the central axis AX of the bulb.

FIG. 22A is a plan view of an incidence surface plate as viewed from a light incidence surface side of the photomultiplier according to the first comparative example and is a plan view corresponding to FIG. 21A. FIG. 22B is a sectional view of the photomultiplier taken on line XIII-XIII shown in FIG. 22A, and FIG. 22C is a sectional view of the photomultiplier taken on line XIV-XIV shown in FIG. 22A.

With the photomultiplier according to the first comparative example, a focusing distance D2, which is a photoelectron transit distance from a photocathode to the first dynodes DY1, is significantly long in comparison to the focusing distance D1 (FIGS. 21B and 21C) of the photomultiplier according to the present invention. Distance variation of the trajectories A2 of the photoelectrons that differ in an emission position on the photocathode is thus large (fluctuation of the photoelectron transit time is large). Also, with the photomultiplier according to the first comparative example, the trajectories A2 of the photoelectrons emitted from a peripheral region of the photocathode must be curved greatly to avoid both a ceramic substrate, for holding the dynodes, and dynode pins (disposed in a periphery of the effective region of the electron multiplier section), for applying predetermined voltages to the respective dynodes. This is done to avoid incidence onto a focusing electron and other metal members disposed between the photocathode and the electron multiplier section and to avoid incidence of photoelectrons onto side wall portions of the first dynode DY1 (portions at which a secondary electron emitting surface is not formed). With the photomultiplier according to the first comparative example in which trajectory modifications of such large degree are performed, a transit time difference between photoelectrons emitted from near a center of the photocathode and photoelectrons emitted from the peripheral region becomes large.

Figure 23A:
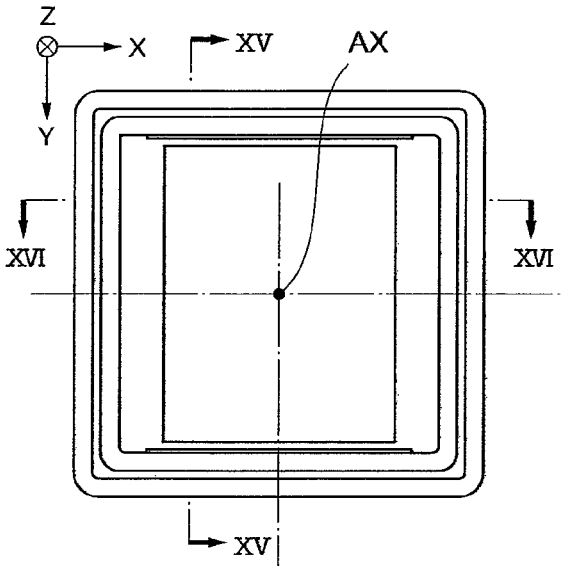
FIGS. 23A to 23C are sectional views, corresponding to FIGS. 21A to 21C, of a photomultiplier of a second comparative example prepared for describing the structural characteristics and effects of the photomultiplier according to the present invention and are diagrams for describing photoelectron trajectories in the photomultiplier according the second comparative example.
Figure 23B:
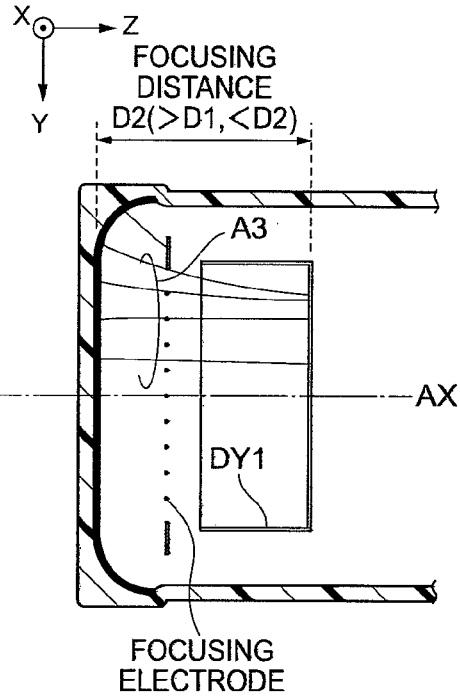
Figure 23C:
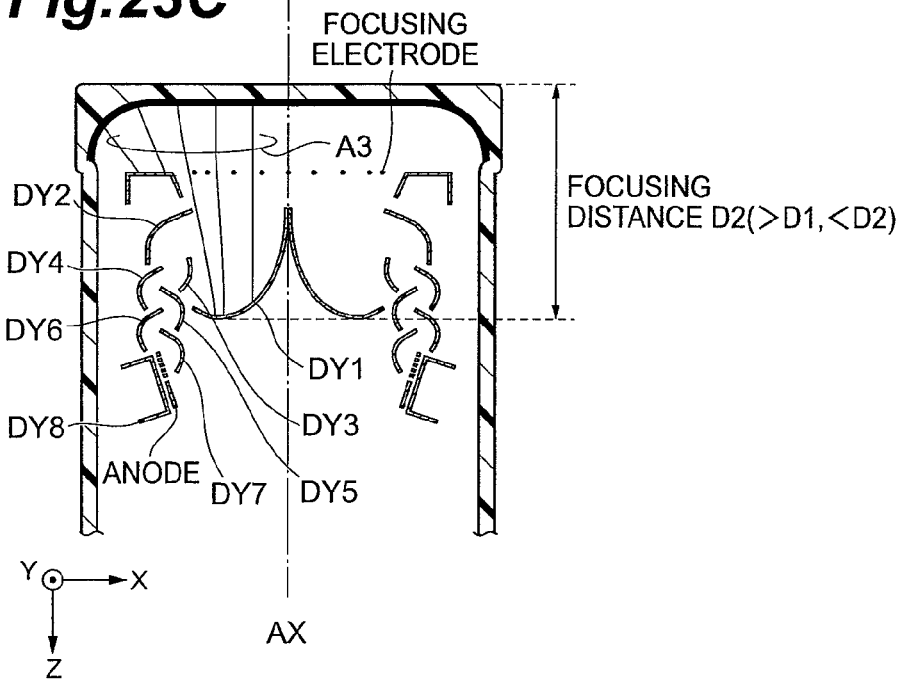

Meanwhile, FIGS. 23A to 23C are sectional views, corresponding to FIGS. 21A to 21C, of a photomultiplier of a second comparative example, prepared for describing the structural characteristics and effects of the photomultiplier according to the present invention and are diagrams for describing photoelectron trajectories in the photomultiplier according the second comparative example. As with the first comparative example, the photomultiplier according to the second comparative example is a multichannel photomultiplier having four electron multiplier channels. FIG. 23A is a plan view of an incidence surface plate as viewed from a light incidence surface side of the photomultiplier according to the second comparative example and is a plan view corresponding to FIG. 21A. FIG. 23B is a sectional view of the photomultiplier taken on line XV-XV shown in FIG. 23A, and FIG. 23C is a sectional view of the photomultiplier taken on line XVI-XVI shown in FIG. 23A.

Although a basic structure of the photomultiplier according to the second comparative example is the same as that of the first comparative example, a focusing distance D3 from the photocathode to the first dynode DY1 is forcibly designed to be shorter than the focusing distance D2 of the photomultiplier according to the first comparative example. With the second comparative example, because a focusing distance that is adequate for curving the trajectories A3 of the photoelectrons emitted from the periphery of the photocathode cannot be secured, the photoelectrons collide with the focusing electrode disposed between the photocathode and the electron multiplier section.

On the other hand, with the photomultiplier according to the present invention (FIGS. 21A to 21C), because the dynode pins are disposed within the effective region AR1 of the photomultiplier 400, the effective region AR1 is more enlarged than in the conventional photomultipliers according to the first and second comparative examples (FIGS. 22A to 23C). By enlargement of the effective region AR1, the trajectory modifications, especially of the photoelectrons emitted from the peripheral region of the photocathode 200 opposing the photoelectron incidence surface of the electron multiplier section 400, are lessened in degree. The focusing distance D1 is thus reduced significantly, and the transit distance difference between photoelectrons emitted from a central region of the photocathode 200 and photoelectrons emitted from the peripheral region becomes small (fluctuations in transit time are small). Also, by the peripheral region of the effective region AR1 of the electron multiplier section 400 being enlarged, it becomes possible to make the photoelectrons, emitted from the peripheral region of the photocathode 200, be incident on the first dynodes (first dynode unit DY1) without greatly modifying the trajectories A1 of the photoelectrons.

Figure 24A:
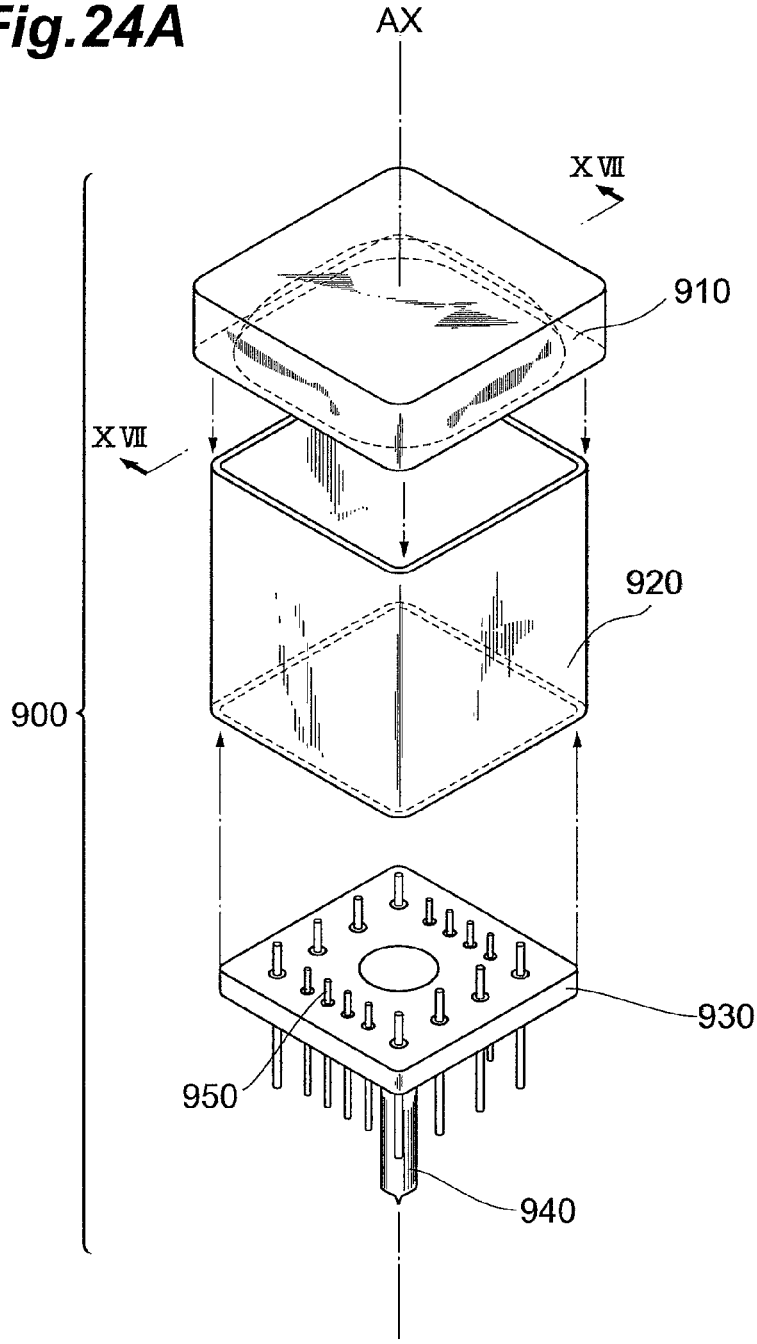
FIGS. 24A and 24B are an assembly process diagram and a sectional view for describing another structure of a sealed container in the photomultiplier according to the present invention.
Figure 24B:
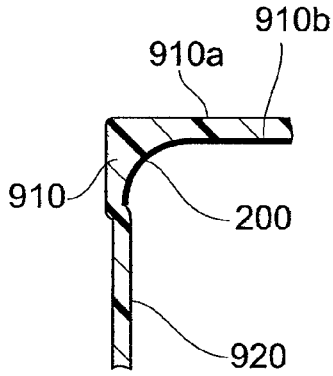

In the above-described embodiment, the sealed container 100 of the photomultiplier according to the present invention includes: the envelope portion, in which the incidence surface plate and the bulb are formed integrally (with the top 110 of the envelope portion, supported by the bulb 120, functioning as the incidence surface plate); and the stem 130, holding the evacuating pipe 600 and the lead pins 700. However, the sealed container applied to the photomultiplier is not restricted to the above-described structure. For example, as shown in FIG. 24A, a sealed container 900 may include: an incidence surface plate 910; a bulb 920; and a stem 930; which are respectively independent glass members. The incidence surface plate 910 has a light incidence surface 910*a* and a light exiting surface 910*b* that oppose each other, and the photocathode 200 is formed on the light exiting surface 910*b* of the incidence surface plate 910 positioned at an inner side of the sealed container 900. The bulb 920 has a shape extending along the predetermined tube axis AX and the incidence surface plate 910 is joined by fusion to one end thereof. The stem 930, constituting a bottom of the sealed container 900, is joined by fusion to the other end of the bulb 920, and, an evacuating pipe 940 is disposed and lead pins 950, electrically connecting the interior and the exterior of the sealed container 900, are installed in respectively penetrating states in the stem 930 as well. FIG. 24B is a sectional view of a structure of the other sealed container taken on line XVII-XVII shown in FIG. 24A and particularly shows a structure near the incidence surface plate 910, on the inner side of which is formed the photocathode 200. Even with such a sealed container 900, by the photocathode 200 being formed on the light exiting surface 910*b* of the incidence surface plate 910, the effects of the above-described photomultiplier are obtained.

As described above, with the photomultiplier according to the present invention, trajectory modifications of the photoelectrons emitted from the peripheral region of the photocathode can be lessened, and because a structure with a short focusing distance can consequently be realized, such response time characteristics, as TTS and CTTD, are improved significantly.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A photomultiplier, comprising:

a sealed container, an interior of which is depressurized to a predetermined degree of vacuum;

a photocathode, housed inside the sealed container, emitting photoelectrons into the sealed container in response to light with a predetermined wavelength;

an electron multiplier section, housed inside the sealed container, emitting secondary electrons in response to the photoelectrons arriving from the photocathode, and successively cascade multiplying the secondary electrons, the electron multiplier section including multiple stages of dynode units, each having one or more dynodes respectively set to a same potential and frame integrally supporting the dynodes;

an anode, arranged inside the sealed container so as to sandwich the electron multiplier section together with the photocathode, capturing the secondary electrons emitted from the electron multiplier section; and a plurality of dynode pins for setting each of the multiple stages of dynode units to a predetermined potential, one end of each being fixed while being electrically connected to the associated one of the multiple stages of dynode units, wherein the electron multiplier includes, at least, a first dynode unit having a first dynode emitting secondary electrons in response to incidence of the photoelectrons emitted from the photocathode, a second dynode unit having a second dynode emitting secondary electrons in response to incidence of the secondary electrons emitted from the first dynode and a third dynode unit having a third dynode emitting secondary electrons in response to incidence of the secondary electrons emitted from the second dynode; and wherein the frames of the first to third dynode units are stacked sequentially from the photocathode toward the anode in a manner such that the frame of the first dynode unit is positioned between the frames of the second and third dynode units.

2. A photomultiplier, comprising:

a sealed container, an interior of which is depressurized to a predetermined degree of vacuum;

a photocathode, housed inside the sealed container, emitting photoelectrons into the sealed container in response to light with a predetermined wavelength;

an electron multiplier section, housed inside the sealed container, emitting secondary electrons in response to the photoelectrons arriving from the photocathode, and successively cascade multiplying the secondary electrons, the electron multiplier section including multiple stages of dynode units, each having two or more dynodes respectively set to a same potential;

an anode, arranged inside the sealed container so as to sandwich the electron multiplier section together with the photocathode, capturing the secondary electrons emitted from the electron multiplier section;

a plurality of dynode pins for setting each of the multiple stages of dynode units to a predetermined potential, one end of each being fixed while being electrically connected to the associated one of the multiple stages of dynode units; and a structure holding the dynode pins while the adjacent dynodes in each dynode unit sandwich a portion of at least the associated dynode pin.

3. A photomultiplier according to claim 2, wherein each of the multiple stages of dynode units includes a plurality of dynodes respectively set to the same potential, and the dynodes set to the same potential are arranged so that the fixed one end of the associated dynode pin is sandwiched by at least two of the dynodes.

4. A photomultiplier according to claim 2, wherein the electron multiplier section includes N ($\geqq 2$) stages of dynode units stacked via insulating spacers from the photocathode toward the anode, and wherein an n-th ($2 \leqq n \leqq N$) stage dynode unit from the photocathode toward the anode has a plurality of dynodes respectively set to the same potential, and a supporting frame maintaining fixed intervals between the dynodes, the supporting frame having a portion positioned between at least two dynodes among the plurality of dynodes, and having a through hole for letting a dynode pin, associated to an (n−1)-th stage dynode unit, penetrate through without electrical contact.

5. A photomultiplier according to claim 4, wherein a portion of the insulating spacer positioned between the n-th stage dynode unit and (n+1)-th stage dynode unit has a through hole holding the dynode pin associated to the (n−1)-th stage dynode unit, and the through hole of the insulating spacer is arranged so that its center coincides with a center of the associated through hole provided in the portion of the supporting frame in the n-th stage dynode unit.

6. A photomultiplier according to claim 4, wherein the insulating spacer positioned between the n-th stage dynode unit and (n+1)-th stage dynode unit has a structure for defining a position, along a direction directed from the photocathode to the anode, of the dynode pin associated to the n-th stage dynode unit.

7. A photomultiplier, comprising:

a sealed container, an interior of which is depressurized to a predetermined degree of vacuum;

a photocathode; housed inside the sealed container, emitting photoelectrons into the sealed container in response to light with a predetermined wavelength;

an electron multiplier section, housed inside the sealed container, emitting secondary electrons in response to the photoelectrons arriving from the photocathode, and successively cascade multiplying the secondary electrons, the electron multiplier section including N ($\geqq 2$) stages of dynode units stacked via insulating spacers along a traveling direction of the photocathode emitted from the photocathode;

an anode, arranged inside the sealed container so as to sandwich the electron multiplier section together with the photocathode, capturing the secondary electrons emitted from the electron multiplier section; and a plurality of dynode pins for setting each of the multiple stages of dynode units to a predetermined potential, one end of each being fixed while being electrically connected to the associated one of the multiple stages of dynode unit, wherein at least an n-th ($2 \leqq n \leqq N$) stage dynode unit from the photocathode toward the anode includes, at least, a plurality of n-th stage dynodes respectively set to the same potential, a supporting frame maintaining fixed intervals between the n-th stage dynodes, and the associated dynode pin among the plurality of dynode pins, and wherein the supporting frame in the n-th stage dynode unit comprises a pair of supports arranged so as to sandwich all of the n-th stage dynodes, and a connecting portion having both ends fixed to the pair of supports while being arranged so as to be sandwiched by at least two of the n-th stage dynodes, and having a structure to which one end of the associated dynode pin is fixed.

8. A photomultiplier according to claim 7, wherein the connecting portion of the supporting frame in the n-th stage dynode unit has aa through hole for letting a dynode pin, associated to an (n−1)-th stage dynode unit, penetrate through without electrical contact.

9. A photomultiplier according to claim 8, wherein the insulating spacer, positioned between the nth stage dynode unit and the (n+1)-th stage dynode unit, has a pair of supports, associated to the pair of supports of the supporting frame in the n-th stage dynode unit, and a connecting portion, associated to the connecting portion of the supporting frame in the n-th stage dynode unit, and wherein the connecting portion of the insulating spacer has a through hole holding the dynode pin associated to the (n−1)-th stage dynode unit, and the through hole of the insulating spacer is arranged so that its center coincides with a center of the associated through hole provided in the connecting portion of the supporting frame in the n-th stage dynode unit.

10. A photomultiplier according to claim 9, wherein the insulating spacer, positioned between the n-th stage dynode unit and the (n+1)-th stage dynode unit, comprises a plurality of spacer elements, respectively having the same shape and being stacked in direct contacting states along a direction directed from the photocathode to the anode.

11. A photomultiplier according to claim 7, wherein the dynode pin associated to the n-th stage dynode unit has a structure for fixing the insulating spacer, positioned between the n-th stage dynode unit and the (n+1)-th stage dynode unit, to the supporting frame of the n-th stage dynode unit so as to constitute a part of the n-th stage dynode unit.

12. A photomultiplier according to claim 7, wherein the insulating spacer, positioned between the n-th stage dynode unit and the (n+1)-th stage dynode unit, has a structure for defining a position, along a direction directed from the photocathode to the anode, of the dynode pin associated to the n-th stage dynode unit.

13. A photomultiplier according to claim 7, wherein the insulating spacer, positioned between the n-th stage dynode unit and (n+1)-th stage dynode unit, has a plurality of light shielding portions arranged so as to plaster the openings sandwiched by the dynodes in the n-th stage dynode unit, and wherein each of the light shielding portions has a plurality slits each letting an alkali metal vapor pass therethrough.

* * * * *